US011560777B2

(12) United States Patent
Bonhomme et al.

(10) Patent No.: US 11,560,777 B2
(45) Date of Patent: Jan. 24, 2023

(54) FILTER SUB FOR DOWNHOLE APPLICATIONS

(71) Applicant: Elite HP & Filtration Group, LLC, Houston, TX (US)

(72) Inventors: Howard J Bonhomme, Houston, TX (US); Kenneth Perry, Lafayette, LA (US)

(73) Assignee: Elite HP & Filtration Group, LLC, Houston, TX (US)

( * ) Notice: Subject to any disclaimer, the term of this patent is extended or adjusted under 35 U.S.C. 154(b) by 104 days.

(21) Appl. No.: 17/146,842

(22) Filed: Jan. 12, 2021

(65) Prior Publication Data

US 2021/0215021 A1 Jul. 15, 2021

Related U.S. Application Data

(60) Provisional application No. 62/960,376, filed on Jan. 13, 2020.

(51) Int. Cl.

| | |
|---|---|
| ***E21B 43/08*** | (2006.01) |
| ***E21B 34/14*** | (2006.01) |
| *E21B 34/10* | (2006.01) |

(52) U.S. Cl.

CPC ..... *E21B 43/086* (2013.01); *E21B 34/14* (2013.01); *E21B 34/103* (2013.01)

(58) Field of Classification Search

CPC ..... E21B 43/086; E21B 43/088; E21B 34/14; E21B 43/08

See application file for complete search history.

(56) References Cited

U.S. PATENT DOCUMENTS

| | | | | |
|---|---|---|---|---|
| 10,633,963 | B1 * | 4/2020 | Perry | E21B 43/088 |
| 2019/0093454 | A1 * | 3/2019 | Styler | E21B 43/26 |
| 2019/0195052 | A1 * | 6/2019 | Yl | E21B 43/10 |
| 2020/0208496 | A1 * | 7/2020 | Veselka | E21B 43/12 |
| 2021/0355799 | A1 * | 11/2021 | Greci | E21B 47/13 |

* cited by examiner

*Primary Examiner* — Yong-Suk (Philip) Ro

(74) *Attorney, Agent, or Firm* — Sheri Higgins; Sheri Higgins Law, PLLC

(57) ABSTRACT

A filter assembly can include a filter element and a fluid inlet for fluid to flow through the filter element. The filter assembly can include bypass ports that are in a closed position from bypass port plugs until the filter screen becomes sufficiently clogged such that the fluid is restricted or prevented from flowing through the filter screen, which causes pressure to build up within the filter assembly. The increase in pressure can cause the bypass port plug to open the bypass ports such that fluid can flow through the bypass ports. The filter assembly can include a debris sleeve that partially or wholly surrounds the filter screen.

20 Claims, 19 Drawing Sheets

FILTER SUB FOR DOWNHOLE APPLICATIONS

TECHNICAL FIELD

The field relates to a filter apparatus that can be positioned in a tubular member or in an appropriately designed housing through which a wellbore fluid flows.

BRIEF DESCRIPTION OF THE FIGURES

The features and advantages of certain embodiments will be more readily appreciated when considered in conjunction with the accompanying figures. The figures are not to be construed as limiting any of the preferred embodiments.

FIG. 13I is a cross-sectional view of the filter assembly of FIG. 13A with the bypass ports opened and showing a second fluid flow path through the filter.

DETAILED DESCRIPTION

Figure 1A:
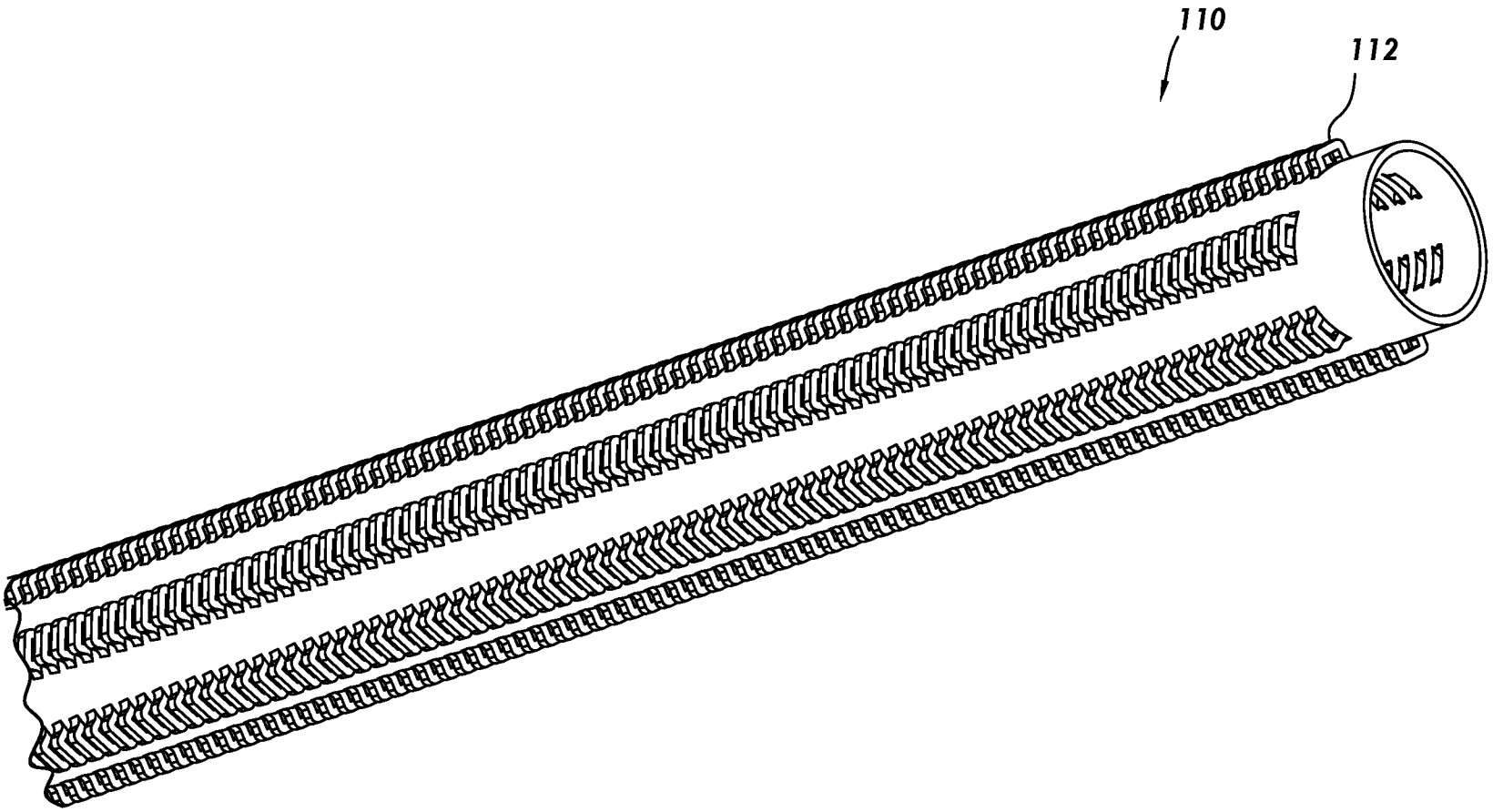
FIG. 1A is a perspective view of a filter screen according to certain embodiments.

Oil and gas hydrocarbons are naturally occurring in some subterranean formations. In the oil and gas industry, a subterranean formation containing oil or gas is referred to as a reservoir. A reservoir may be located under land or offshore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

As used herein, a "fluid" is a substance having a continuous phase that tends to flow and to conform to the outline of its container when the substance is tested at a temperature of 71° F. (22° C.) and at a pressure of one atmosphere "atm" (0.1 megapascals "MPa"). A fluid can be a liquid or gas. A homogenous fluid has only one phase; whereas a heterogeneous fluid has more than one distinct phase. A heterogeneous fluid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and a liquid as the dispersed phase. A heterogeneous fluid will have only one continuous phase, but can have more than one dispersed phase. It is to be understood that any of the phases of a heterogeneous fluid (e.g., a continuous or dispersed phase) can contain dissolved or undissolved substances or compounds.

A well can include, without limitation, an oil, gas, or water production well, a geothermal well, or an injection well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. As used herein, "into a well" means and includes into any portion of the well, including into the wellbore or into the near-wellbore region via the wellbore. As used herein, a "wellbore treatment fluid" is any fluid used in a wellbore operation.

A wellbore is formed using a drill bit. A drill string can be used to aid the drill bit in drilling into the subterranean formation to form the wellbore. The drill string can include a drilling pipe. During drilling operations, a drilling fluid, sometimes referred to as a drilling mud, may be circulated downwardly through the drilling pipe, and back up the annulus between the wellbore and the outside of the drilling pipe. The drilling fluid performs various functions, such as cooling the drill bit, maintaining the desired pressure in the well, and carrying drill cuttings upwardly through the annulus between the wellbore and the drilling pipe.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wall of a wellbore and the outside of a tubing string in an open-hole wellbore; the space between the wall of the wellbore and the outside of a casing in a cased-hole wellbore; and the space between the inside of a casing and the outside of a tubing string in a cased-hole wellbore.

There are other downhole assemblies that can be used during drilling operations in addition to a drill bit. Some downhole assemblies that the drilling fluid comes in contact with can be adversely affected by debris in the drilling mud. Sensitive equipment, such as wellbore logging tools and "measurement while drilling (MWD)" tools, can be damaged by the debris in the mud, which can cause the tools to function incorrectly. Examples of debris can include pipe scale, objects inadvertently dropped into the wellbore from the drill floor, cuttings, and many other types of unwanted objects. A variety of other wellbore treatment fluids, such as spacer fluids and workover fluids, may contain debris. Accordingly, a filter assembly can be used to help filter the debris in order to protect the downhole tools.

Although designs vary, the current method to filter unwanted debris from a wellbore treatment fluid, such as a drilling fluid, is to place a filter assembly into the flow stream. The filtering element of these assemblies is generally composed of a variety of materials, for example, perforated material, wire mesh, or bars welded with a predetermined gap between each bar. As a debris-laden fluid flows through the filter media, the debris is trapped on the inlet side of the filter screen. The flow path through the filter assembly can vary and can be based on the application it is used in. The flow path can traverse from the inside of the filter screen flowing to the outside of the screen or can traverse from the outside into the center of the filter screen.

With continued use, the filter screen can become clogged with debris, and fluid flow through the filter assembly can become essentially blocked. When the wellbore treatment fluid stops flowing to the devices located below the filter assembly, the wellbore operation must stop until fluid flow through the filter assembly can be restored. Typically, fluid flow is restored by retrieving the filter assembly up to the drilling platform in order to remove the debris. A common retrieval method, which is commonly known to those skilled in the art, involves using a male or female fishing neck that is a structural component of an upper sub of the filter assembly. A retrieval tool can mate with the fishing neck and the filter assembly can be pulled from the wellbore to the surface where it can be cleaned. The filter assembly can be run back into the housing located within the wellbore after cleaning wherein filtration of the wellbore fluid can resume.

For filter assemblies where the wellbore treatment fluid enters from the outside of the filter screen and travels through to the inside of the screen, the filtered debris can pack around the outside of the screen and lodge within the screen. One significant disadvantage of these current assemblies is that the debris can undesirably dislodge from the outside of the screen when the filter screen is retrieved for cleaning. The dislodged debris can permeate the treatment fluid and enter the downhole tools that the filter assembly is meant to protect. Thus, there is a need and an ongoing industry wide concern for improved filter assemblies that can retain dislodged debris when the filter screen is retrieved for cleaning.

Moreover, filtered debris can be fibrous and potentially sticky. When the filter screen needs cleaning, the debris that is trapped inside the filter sub, or even the debris that may be trapped in the holes of the screen, must be forced back through holes of the screen using a cleaning method such as a pressure washer. Another significant disadvantage to current filter assemblies is the inability to disassemble the various components of the filter assembly, which would simplify cleaning by giving easy access to the screen to be able to remove the stuck debris. Thus, there is a long-felt need and an ongoing industry-wide concern for improved filter assemblies that can be disassembled for easier cleaning.

Additionally, some filter screens incorporate bypass ports that allow a small portion of the treatment fluid to bypass the flow path through the clogged filter in order to continue drilling operations—albeit at a reduced rate. One significant disadvantage with current bypass port designs is that the ports are continually open. The open bypass ports allow debris that exists in the treatment fluid to bypass the filter screen and flow into downhole tools that the screen is meant to protect. Thus, there is an ongoing industry-wide need for improved filters that solve the problems of current designs.

It has been discovered that a filter assembly can be used to filter debris or other particulates from a wellbore treatment fluid. The filter assembly can be used above or below ground with the appropriate housings. The novel filter assembly includes one or more bypass ports that remain closed as fluid flows through a filter screen until such a time as the filter screen becomes sufficiently clogged, which causes the bypass ports to open thereby allowing some or all of the fluid to flow into the bypass ports. Components of the filter assembly can be disassembled for easier cleaning of a clogged filter after retrieval from the wellbore. It has also been discovered that a filter assembly can include a debris sleeve that retains dislodged debris during retrieval of the filter for cleaning.

According to certain embodiments, a filter assembly for use in a wellbore comprises: a first fluid-flow path; a filter screen, wherein a fluid flows through the filter screen via the first-fluid flow path; a second fluid-flow path; and one or more bypass ports, wherein the one or more bypass ports are in a closed position when the fluid flows through the first fluid-flow path, wherein the one or more bypass ports convert from the closed position to an open position when a predetermined pressure is obtained in the first fluid-flow path, and wherein at least a portion of the fluid flows through the second fluid-flow path when the one or more bypass ports are in the open position.

According to certain embodiments, a method for treating a portion of a wellbore comprises: introducing a filter assembly into the wellbore, wherein the filter assembly comprises: a first fluid-flow path; a filter screen; a second fluid-flow path; and one or more bypass ports; flowing a wellbore treatment fluid through a filter screen via the first fluid-flow path, wherein the one or more bypass ports are in a closed position when the wellbore treatment fluid flows through the first fluid-flow path; and causing or allowing the one or more bypass ports to convert from the closed position to an open position, wherein at least a portion of the wellbore treatment fluid flows through the second fluid-flow path when the one or more bypass ports are in the open position.

According to certain embodiments, a filter assembly for use in a wellbore comprises: a housing; a filter screen located within a portion of the housing; and a debris sleeve located circumferentially around at least a portion of the filter screen, wherein the debris sleeve is closed at a bottom end, and wherein the debris sleeve is located within the housing.

It is to be understood that the discussion of any of the embodiments regarding the filter assembly is intended to apply to all of the method and apparatus embodiments without the need to repeat the various embodiments throughout. Any reference to the unit "gallons" means U.S. gallons.

Figure 1B:
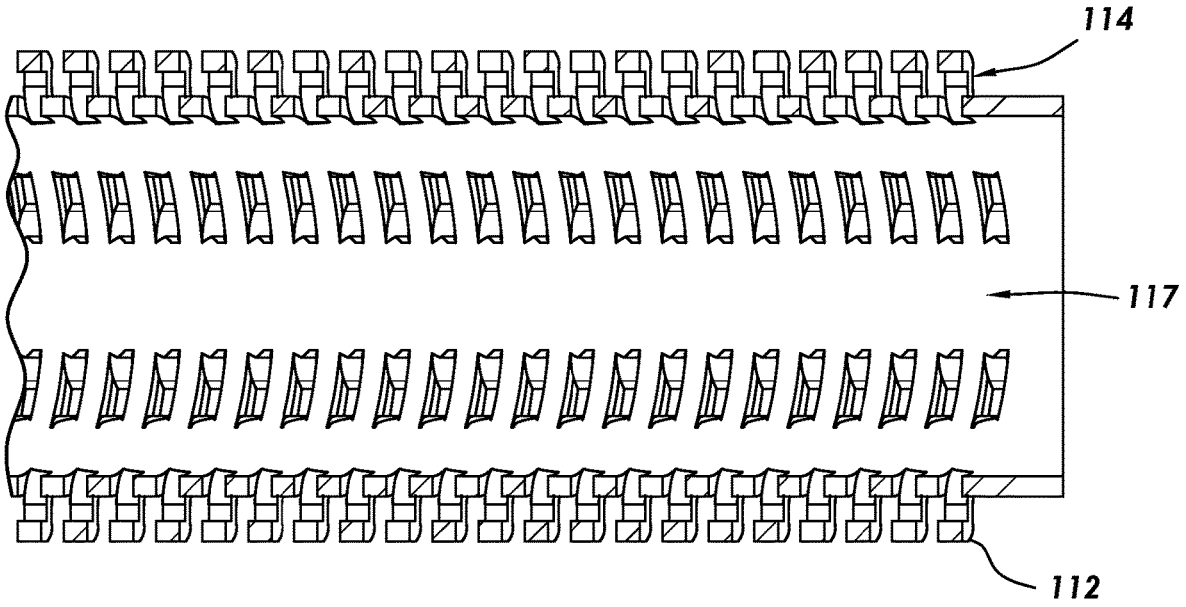
FIG. 1B is a cross-sectional view of the filter screen of FIG. 1A.
Figure 2:
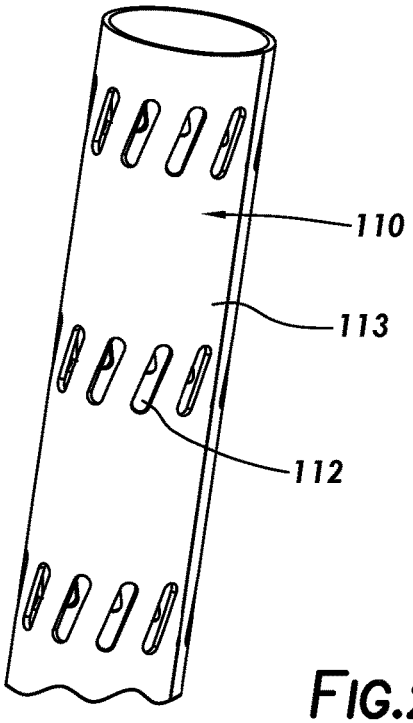
FIG. 2 is a perspective view of a filter screen according to certain embodiments.

Turning to the figures, FIGS. 1A and 1B depict a filter screen 110 of a filter assembly 100 according to certain embodiments. The filter screen 110 can be fabricated using a variety of manufacturing processes. By way of example, the filter screen 110 can be punch formed from flat material, such as polymer, steel, stainless steel, or any material that would be able to withstand the environment and intended application. After punching, cutting, molding, or forming, the material can then be formed into the cylindrical shape seen in the following figures or into other shapes, including without limitation, hexagonal, before being joined into its final form with weldments as shown in FIG. 2. The filter screen 110 can be a variety of dimensions. Lengths can range from 9 to 96 inches "in" (22.9 to 243.8 centimeters "cm") and outer diameters in the range from 1 to 20 in (2.5 to 50.8 cm). The dimensions can be selected based in part on the anticipated amount of debris in the fluid and other wellbore conditions.

As can be seen in FIGS. 1A and 1B, the filter screen 110 can include a filter medium 112, for example louvers. The filter medium 112 can be fabricated on a filter body 113. As seen in FIG. 1A, the louvers can form bridges over openings in the filter body 113. The filter medium 112 can also be oriented in such a way that streamlines the flow of a wellbore fluid (e.g., a drilling, spacer, or workover fluid) through a first fluid-flow path 117 when the fluid enters the filter screen 110 from the inside of the filter screen 110 or through the filter medium 112 in a filter medium flow path 114. The louvers can redirect the fluid flow, thereby reducing the pressure loss across the filter screen 110, which in turn allows the fluid to deliver more energy to downhole tools. The bridges formed by the louvers can aid in breaking up long fibrous debris that would otherwise be able to flow out of a filter element that is made by simple slots cut in the filter body. The bridges can shear fibrous debris in the fluid as it flows through the openings in the filter body. This shearing effect occurs regardless of whether the fluid enters from the outside of the filter screen 110 or if the fluid enters from the inside of the filter screen 110. Another benefit to the louver/bridge design can be seen when the fluid enters from the outside of the filter screen 110, which creates two fluid inlets (one entering from either side of the bridge before proceeding through the openings in the filter body) into the filter screen; thereby, doubling the time that a filter can be used before both inlets are clogged.

FIG. 2 is another example of other types of a filter medium 112 that can be used in the filter screen 110. As shown in FIG. 2, the filter medium 112 can be in the form of slots located circumferentially around the filter body 113. The slots can have a variety of dimensions and shapes. The number of slots, the circumferential spacing, and the axial spacing can be selected, based in part, on the desired flow rate through the filter screen 110 and the quantity and/or type of debris anticipated. The slots can be formed into the filter body in a manner that creates a beneficial effect to the filtration function. By way of example, the slots can be angled as shown in FIG. 2. The angled slots can create a cyclonic effect to the fluid flow as it exits or enters the filter screen 110 to add a beneficial effect to the equipment below the filter. As with any of the filter media described herein, the slot or opening profile, quantity, and orientation can be selected to achieve the desired open-flow area and the desired amount of filtration of the wellbore treatment fluid.

Figure 3:
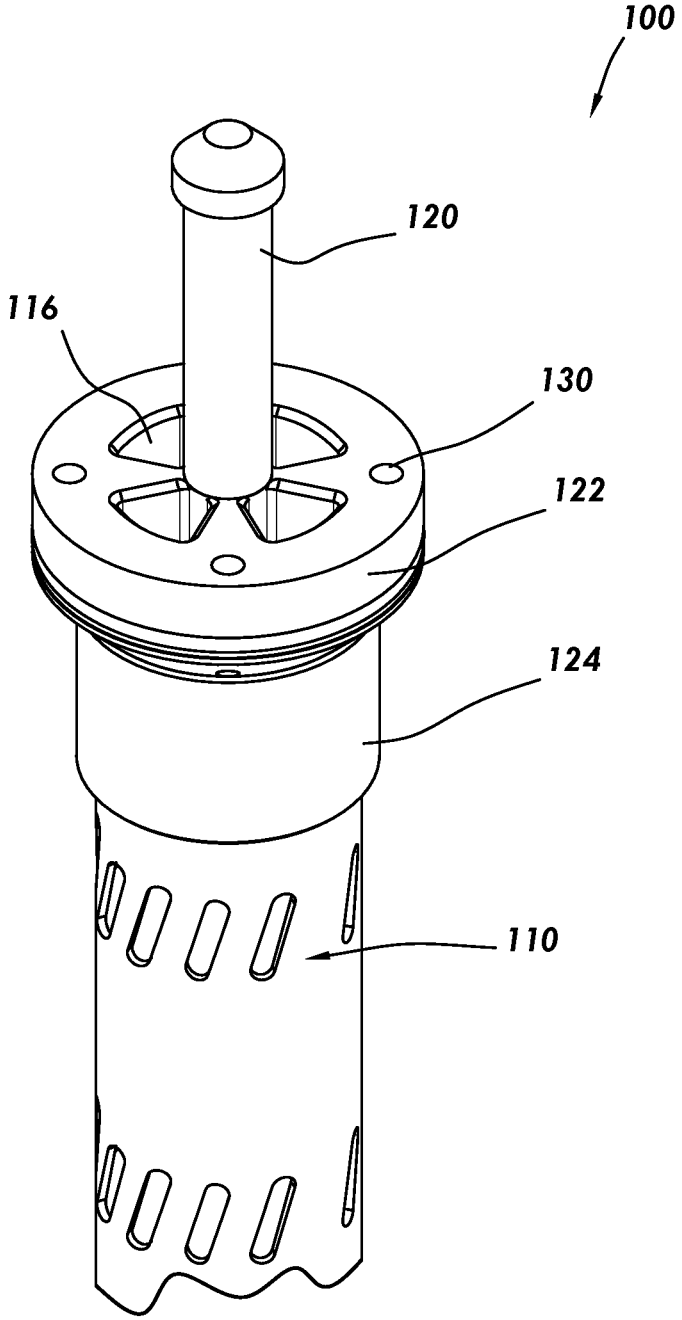
FIG. 3 is a perspective view of a filter assembly containing a plurality of bypass ports and check valves as bypass port plugs according to certain embodiments.
Figure 4:
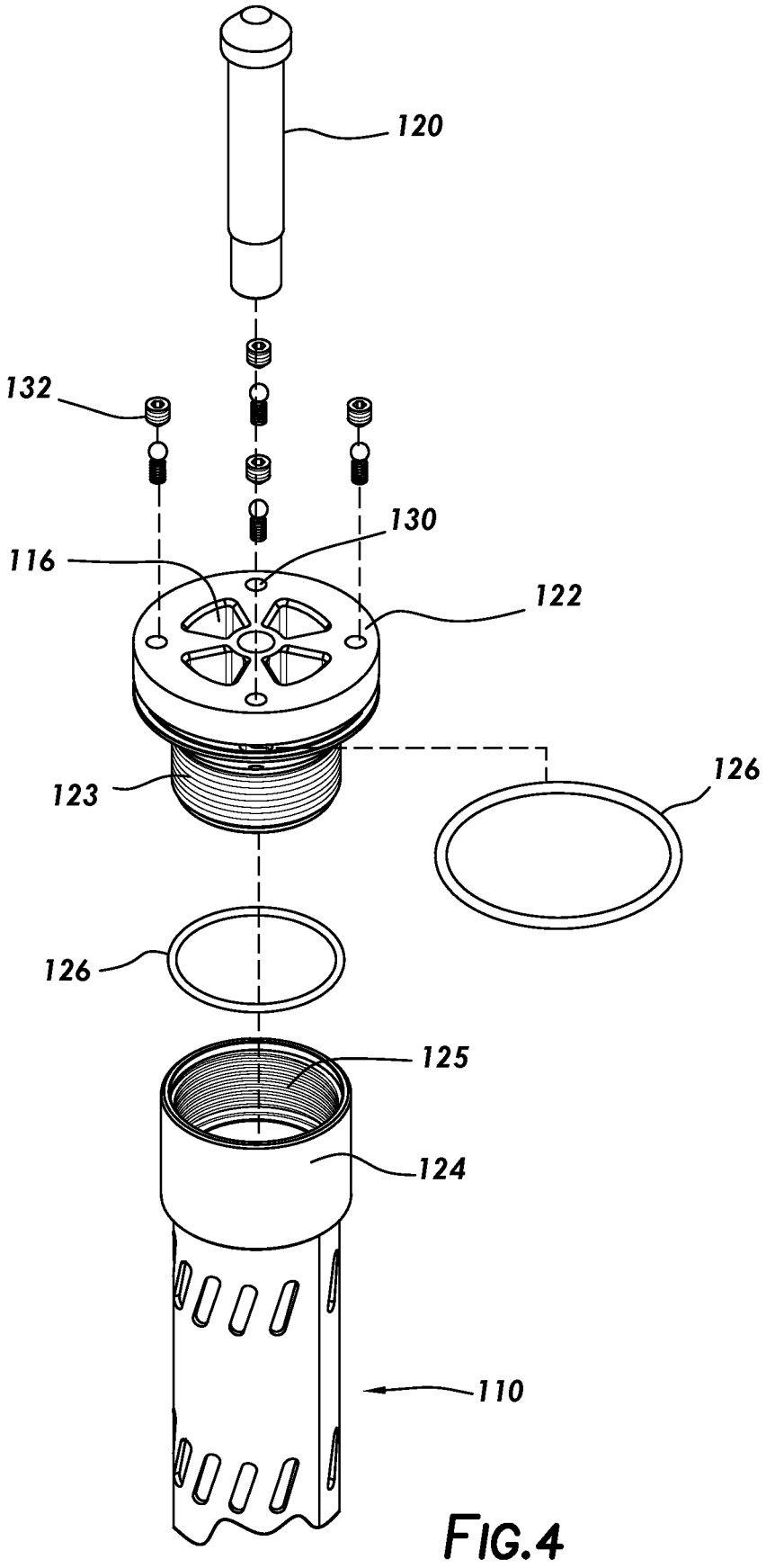
FIG. 4 is an exploded perspective view of the filter assembly of FIG. 3.

According to certain embodiments and as shown in FIGS. 3 and 4, the filter assembly 100 can include a filter screen 110 that can be removed from the filter assembly 100 to simplify cleaning. The filter screen 110 can be attached to a lower sub 124. As shown in the exploded perspective view of FIG. 4, the lower sub 124 can be threadingly connected to an upper sub 122. One or more sealing elements 126 can be positioned into the threaded connection to restrict fluid flow. As shown in FIG. 4, a larger diameter sealing element 126 can be positioned within the upper sub 122 to prevent fluid flow between the upper sub and the housing 118 (shown in FIG. 5), and a smaller diameter sealing element 126 can be positioned into the lower sub 124 to prevent fluid flow between the upper and lower subs. The upper sub 122 can include male threads 123 for threadingly engaging with female threads 125 of the lower sub 124. Although shown as a threaded connection, the filter screen 110 can be releasably attached to upper sub 122 using any appropriate fastening method that provides simple disassembly for cleaning. Examples of other types of attachments can include, but are not limited to, shear pins, pinning, retaining clips, glues, set screws, or retaining pins in J slots. According to certain other embodiments, the lower sub 124 and the upper sub 122 are not removably attached to each other, and a bottom plate 111 (shown in FIG. 8) can be removed to clean the filter screen 110. The bottom plate 111 can be attached using the aforementioned attachments, or alternatively, the bottom plate 111 can be permanently affixed to a bottom end of the filter body 113.

The filter assembly 100 includes a first fluid-flow path 117, wherein a fluid flows through the filter screen 110 via the first fluid-flow path 117. The filter assembly 100 can also include one or more filter inlet ports 116. A wellbore treatment fluid can enter the filter screen 110 through the filter inlet ports 116 and flow through the first fluid-flow path 117. As shown, for example, in FIGS. 1B, 3, 4, and 5, the first fluid flow path 117 can be through an inside of the filter screen 110, traverse through the filter screen 110, and to an outside of the filter screen 110. By way of another example and as shown in FIGS. 6A and 6B, the first fluid flow path 117 can be from an outside of the filter screen 110, traverse through the filter screen 110, into an inside of the filter screen 110, and out of the filter screen 110 via a perforated bottom plate 111. The filter medium 112 can be designed such that the filter screen 110 partially or completely captures debris that is filtered out of the wellbore treatment fluid. The debris can become embedded in the filter medium 112 and essentially coat the inside or the outside of the filter screen 110 depending on the direction of the first fluid flow path 117.

The filter inlet ports 116 can be a variety of dimensions and shapes. The total number, spacing, orientation, dimensions, and shape can be selected based in part on whether the first fluid-flow path 117 is from the inside or outside of the filter screen 110, the desired flow rate of the fluid flowing through the first fluid-flow path 117, and the filtering capability of the filter screen 110 (which can be dependent on the amount of debris and the dimensions of the filter screen).

The filter assembly 100 includes one or more bypass ports 130. The filter assembly 100 also includes a second fluid-flow path 136. The bypass ports 130 are in a closed position when the fluid flows through the first fluid-flow path 117. In this manner, a fluid, such as a wellbore treatment fluid, can flow through the filter screen 110 via the filter inlet ports 116 within the first fluid-flow path 117. When the filter screen 110 becomes clogged with debris such that the fluid is wholly or substantially restricted from flowing through the first fluid-flow path 117, the bypass ports 130 can convert from the closed position to an open position. After the bypass ports 130 convert to the open position, at least a portion of the fluid can flow through the bypass ports 130 within the second fluid-flow path 136.

The filter assembly 100 can include one or more bypass port plugs 132. The bypass port plugs 132 can be positioned within the bypass ports 130. The bypass port plugs 132 can keep the bypass ports 130 in the closed position until such time as the filter screen 110 becomes clogged. As used herein, the phrase "bypass port plug" and all grammatical variations thereof means any device that is capable of closing a fluid flow path through the bypass ports and is not meant to limit the bypass port plug to any geometric shape, device, or design. As will be discussed in further detail below, the bypass port plugs 132 can be a variety of devices.

Figure 5:
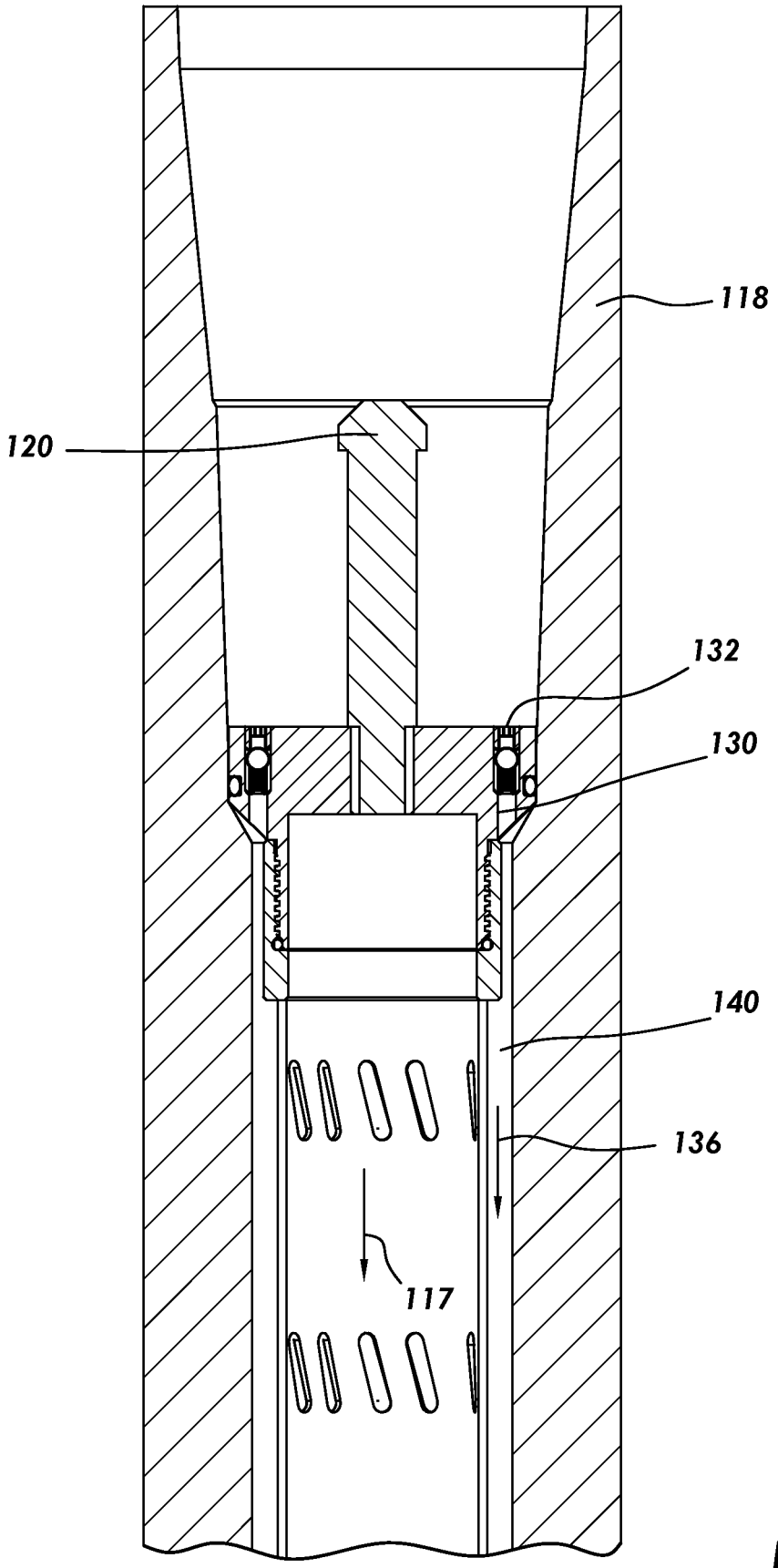
FIG. 5 is a cross-sectional view of the filter assembly of FIG. 3.
Figure 6A:
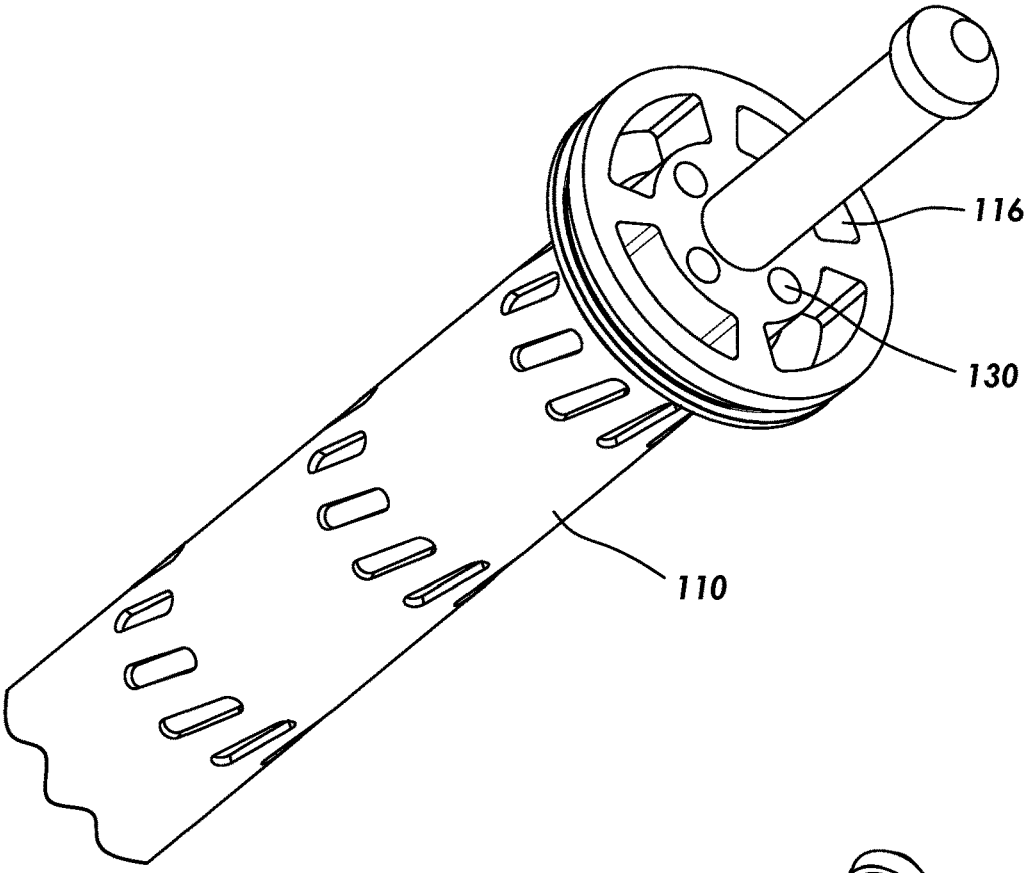
FIG. 6A is a top perspective view of a filter assembly having multiple bypass ports and ball check valves as the bypass port plugs according to certain embodiments.
Figure 6B:
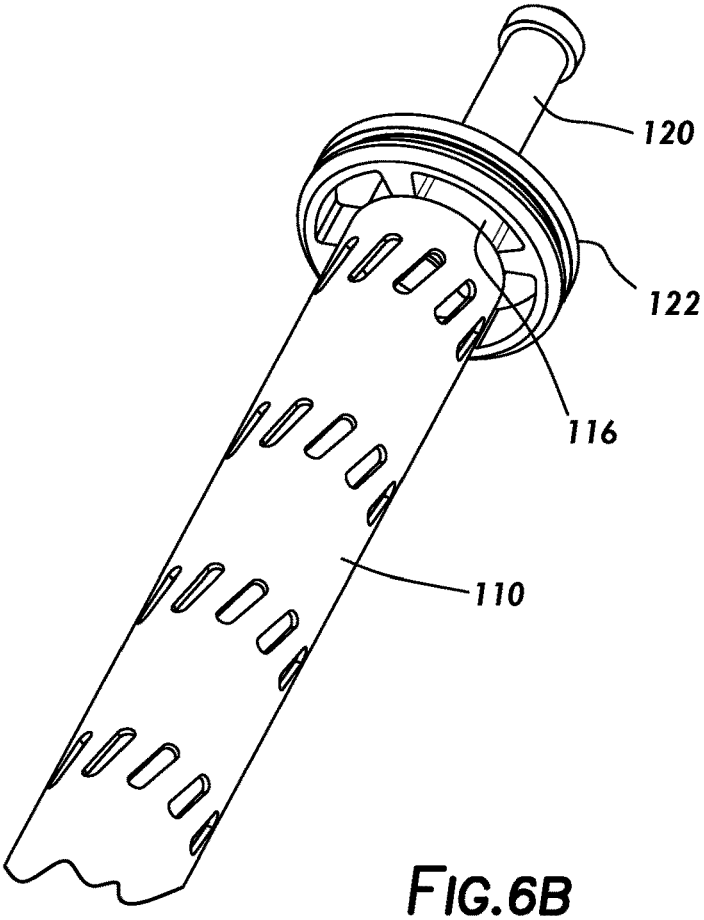
FIG. 6B is a bottom-side perspective view of the filter assembly of FIG. 6A.
Figure 7A:
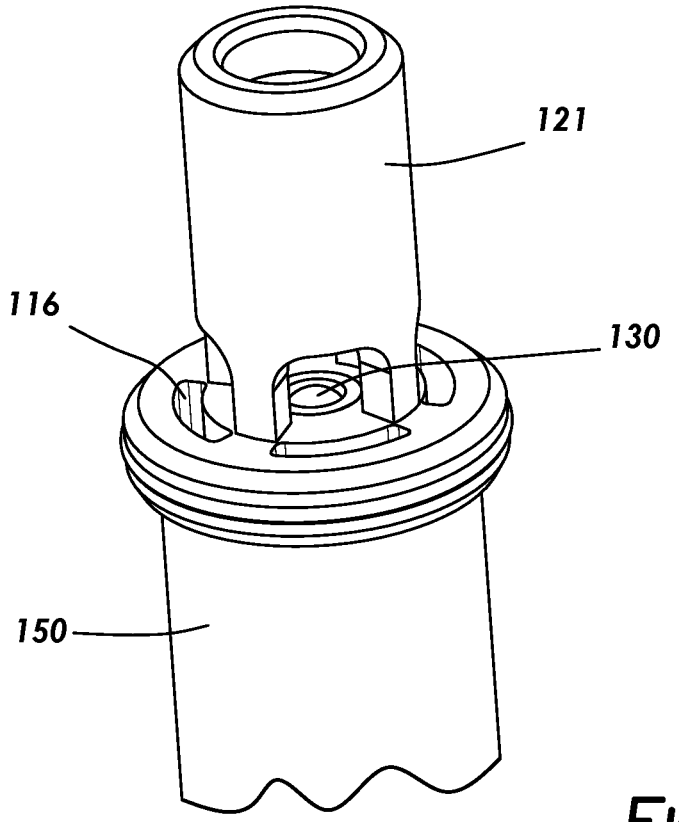
FIG. 7A is a partial perspective view of an upper section of a filter assembly having a single bypass port and a ball check valve as the bypass port plug according to certain embodiments.
Figure 7B:
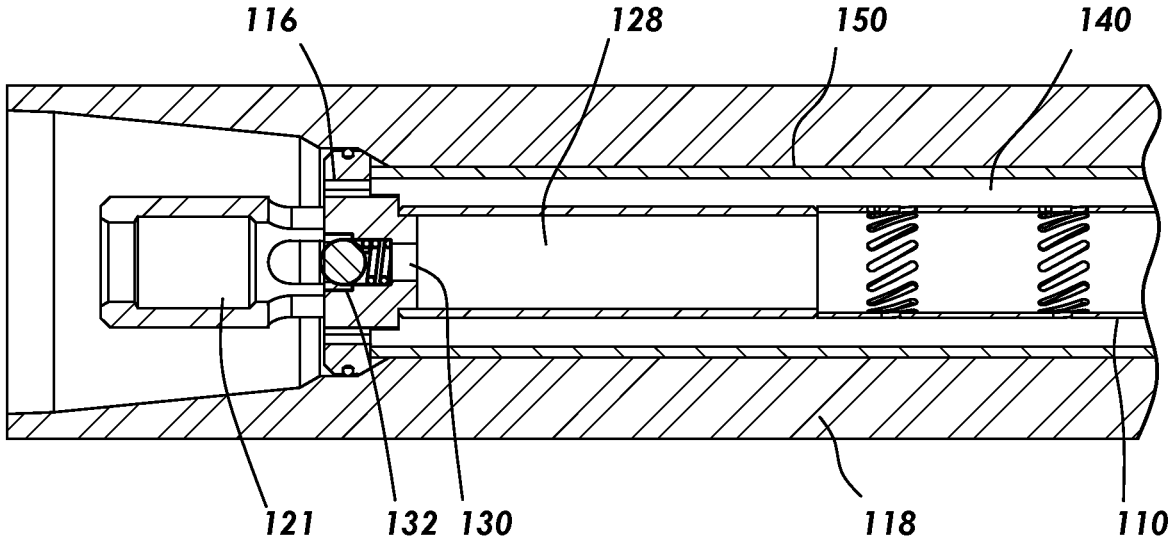
FIG. 7B is a partial cross-sectional view of the filter assembly of FIG. 7A and including a full debris sleeve according to certain embodiments.

As shown in FIGS. 3-7B, the bypass port plugs 132 can be a ball check valve. FIGS. 3-5 show the filter inlet ports 116 being located near a center of the filter screen 110 and the bypass ports 130 being located around a periphery of the upper sub 122. In this manner, the first fluid-flow path 117 will be through an inside of the filter screen 110 to an outside of the filter screen 110, and the second fluid-flow path 136 through the bypass ports 130 will be outside the filter screen 110. The filter inlet ports 116 can be located around a periphery of the filter screen 110 and a single bypass port 130 can be located near the center of the upper sub 122 (as shown in FIGS. 7A and 7B) or a plurality of bypass ports 130 can be located near the center of the upper sub (as shown in FIGS. 6A and 6B). In this manner, the first fluid-flow path 117 will be from an outside of the filter screen 110 to an inside of the filter screen 110, and the second fluid-flow path 136 through the bypass ports 130 will be through the inside the filter screen 110. The ball check valve(s) as the bypass port plugs 132 remains closed and seals the bypass ports 130 until the filter screen 110 becomes clogged with debris. When the screen becomes sufficiently clogged such that fluid flowing through the first fluid-flow path 117 is substantially restricted or stops, the pressure in the filter assembly 100 can increase to at least a minimum pressure such that the pressure pushes the balls of the check valves into an open position and allows the fluid to bypass the filter and flow into the second fluid-flow path 136.

The filter assembly 100 can also include a fishing neck for retrieving the filter screen 110 for cleaning after the bypass ports 130 are opened. The fishing neck can be a male fishing neck 120 (as shown in FIGS. 3-6B and 12A-13I) or a female fishing neck 121 (as shown in FIGS. 7A-11C). Selection of a male fishing neck 120 or a female fishing neck 121 can be determined based in part on the desired location of the filter inlet ports 116 and the bypass ports 130 and the type of device used as the bypass port plug 132. A retrieval tool can be used to matingly lock with the fishing neck in order to pull the upper sub 122, lower sub 124, and filter screen 110 to the surface for cleaning.

As shown in FIG. 7B, the filter assembly 100 can be located within a housing 118. The housing 118 can be threadingly connected to a tubing string at a location that is above the downhole tools the filter assembly 100 is meant to protect from debris. According to certain embodiments, the filter assembly 100 can further include a debris sleeve 150. The debris sleeve 150 can be located circumferentially around at least a portion of the filter screen 110 and inside the housing 118. An annulus 140 can exist between the outside of the filter screen 110 and an inside of the debris sleeve 150 or between the outside of the filter screen 110 and the inside of the housing 118 in embodiments where a debris sleeve is not included. The debris sleeve 150 can be formed as part of the lower sub 124.

The filter assembly 100 can also include a wear collar 128. The wear collar 128 can be part of the lower sub 124 and located above the filter screen 110 or welded between the lower sub and the filter screen. Although not shown in the drawings, the wear collar 128 can be removably inserted into an upper end of the filter body 113 and can hang on a lip of the lower sub 124 via a flange that extends around the top of the wear collar 128—similar to a liner as those skilled in the art will be familiar with. When fluid flows into the filter inlet ports 116 of the filter screen 110, nonlinear flow can occur as the fluid exits the filter inlet ports 116. This nonlinear flow can produce a scouring action on the filter screen 110. Over time, the scouring action can cut entirely through the top of the filter screen 110 and cause the separation of the screen from the lower sub 124. Because the scouring action generally only occurs in the immediate vicinity of the exit of the filter inlet ports 116, the wear collar 128 can be included just below the filter inlet ports 116 to overcome the scouring action, which can extend the life of the filter screen 110 and weldments of the screen to the lower sub 124. The length of the wear collar 128 can be selected such that the wear collar extends below the area of nonlinear flow. The wear collar 128 can be used when the first fluid-flow path 117 is through the inside or the outside of the filter screen 110.

Figure 8:
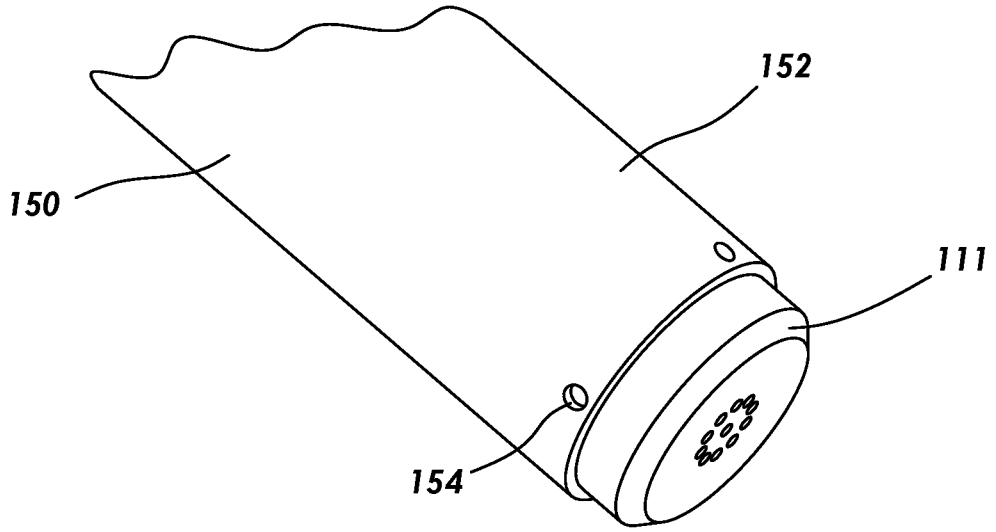
FIG. 8 is a partial perspective view of a bottom of the filter assembly of FIG. 7 showing the bottom of the full debris sleeve.

As shown in FIG. 8, the filter screen 110 can include a bottom plate 111. The bottom plate 111 can be removably attached to the filter body 113 or be permanently affixed to a bottom end of the filter body 113. The bottom plate 111 can include one or more perforations as an outlet for fluid to flow through the inside of the filter screen 110. A bottom end 152 of a debris sleeve 150 can include one or more holes 154 for attaching the debris sleeve 150 to the bottom plate 111. Attachment of the debris sleeve 150 to the bottom plate 111 can utilize fasteners or other retention devices including, but not limited to, retaining clips or pins. In this manner, the debris sleeve 150 can be removed to clean a debris-clogged filter screen 110.

The debris sleeve 150 can assist in retention of debris on the filter screen 110 in the event that the screen needs to be pulled up to the surface for cleaning. For cleaning, the housing 118 and the tubing string can remain in the wellbore. Depending on the type of debris, the debris sleeve 150 can be used to capture any debris that falls off the filter screen 110 during retrieval and inhibit or prevent the dislodged debris from falling down into the wellbore to any downhole tools located below. As used herein, the relative term "below" is used for orientation purposes only and means at a location farther away from the wellhead.

Figure 9A:
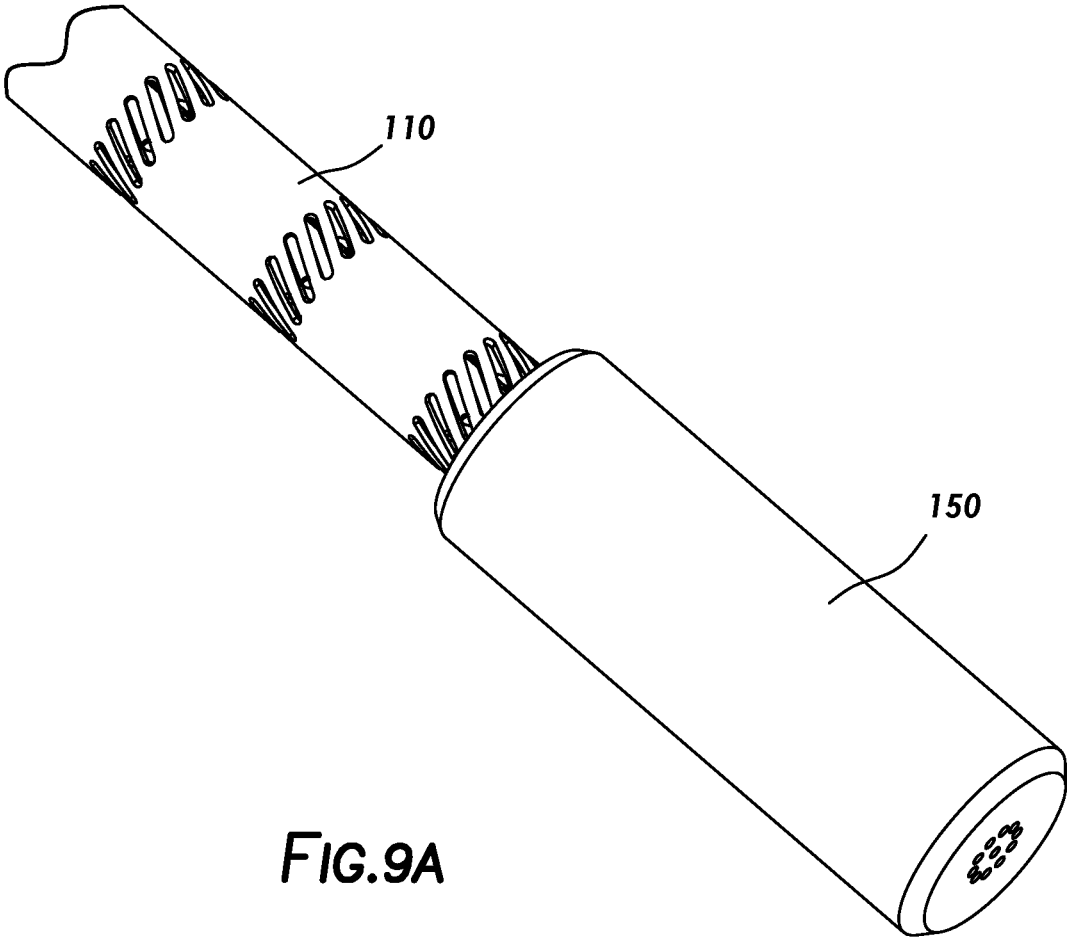
FIG. 9A is a partial bottom perspective view of a filter assembly having a partial debris sleeve according to certain embodiments.
Figure 9B:
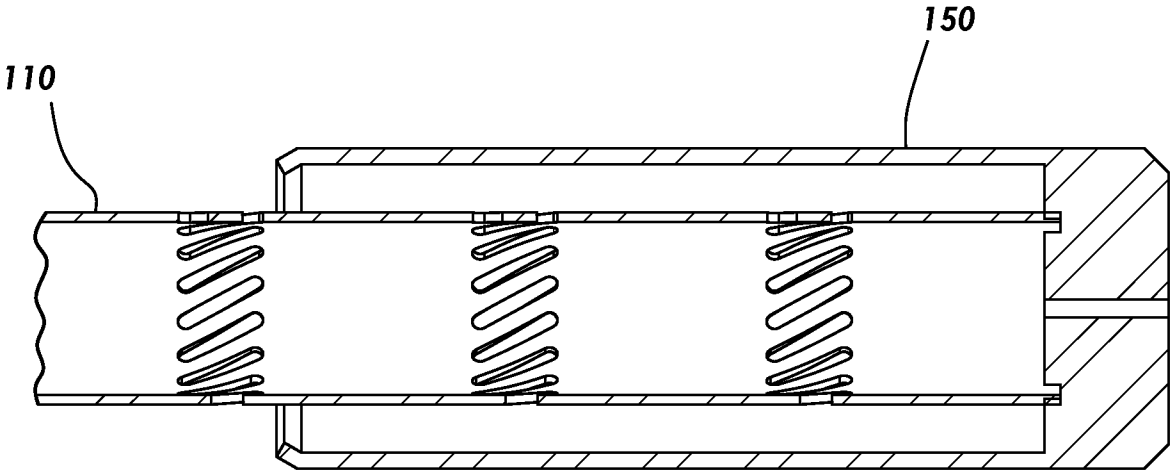
FIG. 9B is a cross-sectional view of the filter assembly of FIG. 9A.

The debris sleeve 150 can completely surround the filter screen 110 or can partially surround a bottom end of the filter screen 110 (as shown in FIGS. 9A and 9B). Determining whether to use a full or partial debris sleeve can depend on the type of debris that is anticipated in a particular wellbore environment and/or the type of wellbore treatment fluid being used. By way of example, for fibrous or sticky debris, a partial debris sleeve 150 may be appropriate. By way of another example, if the collected debris is expected to be similar to pebbles or other materials that do not adhere to one another, then a full debris sleeve 150 may be appropriate. A full debris sleeve 150 can be removed for cleaning of the filter screen 110. A partial debris sleeve 150 can be permanently attached to the bottom plate 111 or can be removable.

FIGS. 10A-10D show a single bypass port 130 located near a center of the upper sub 122 with the second fluid flow path 136 running inside the filter screen 110 and a burst disk as the bypass port plug 132. As can also be seen, the upper sub 122 can include a female fishing neck 121 to reduce the chances of the burst disk being prematurely ruptured. Prior to clogging of the filter screen 110, the burst disk can prevent fluid flow into the second fluid flow path 136 by blocking the bypass port 130. If the filter becomes clogged, a worker can overpressure the system to burst the disk to convert the bypass port 130 to an open position. Alternatively, pressure within the filter assembly 100 can naturally increase as the filter screen 110 becomes clogged with debris to rupture the burst disk.

Figure 10A:
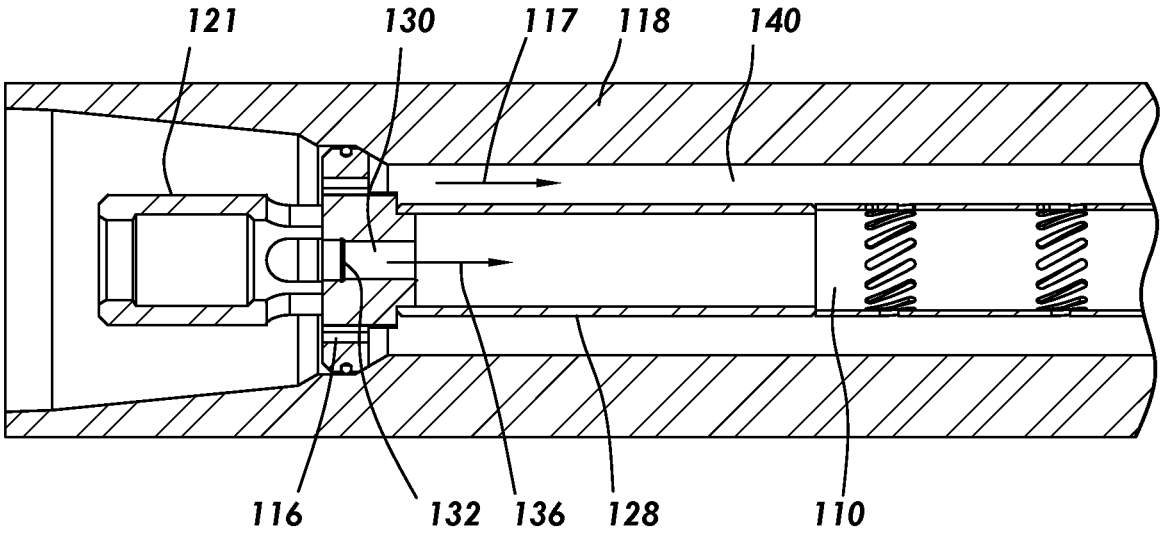
FIG. 10A is a cross sectional view of a filter assembly having a burst disc as the bypass port plug according to certain embodiments.
Figure 10B:
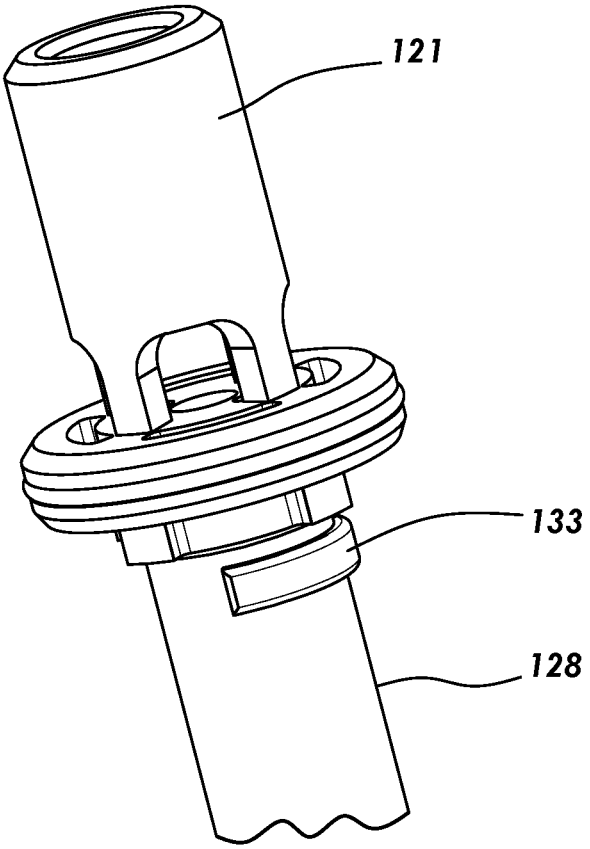
FIG. 10B is a perspective view of a filter assembly having a burst disc as the bypass port plug and further including a port plug housing according to certain other embodiments.
Figure 10C:
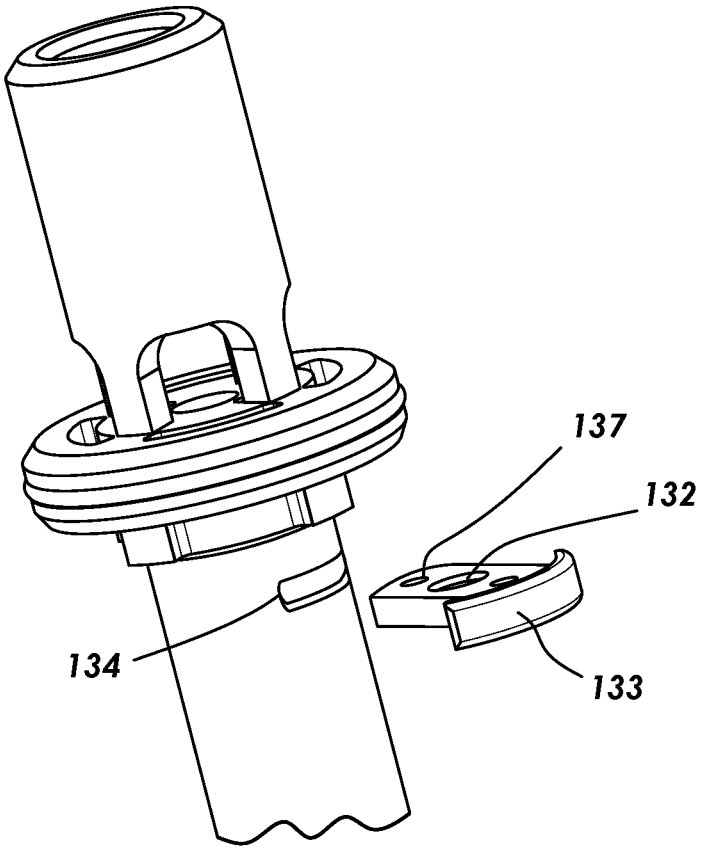
FIG. 10C is an exploded perspective view of the filter assembly of FIG. 10B.
Figure 10D:
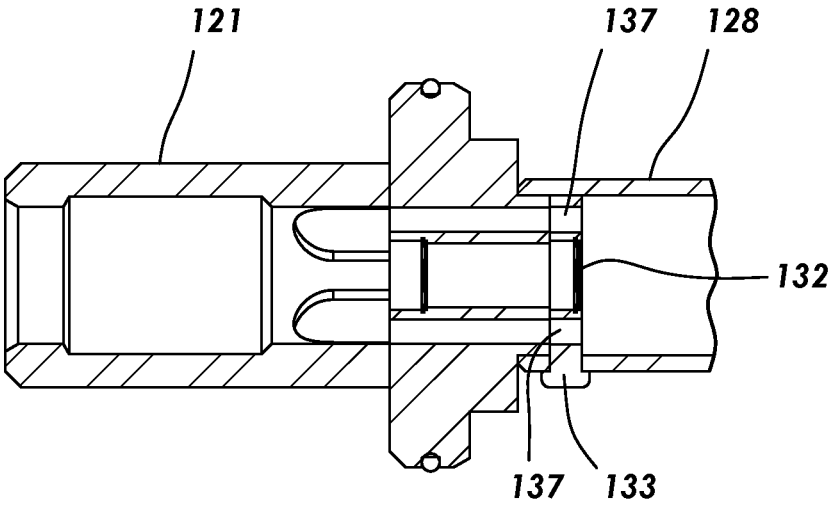
FIG. 10D is a detailed cross sectional view of the filter assembly of FIG. 10B.

As shown in FIGS. 10B-10D, the wear collar 128 can include a port plug housing receiver 134. The burst disk as the bypass port plug 132 can be installed in a port plug housing 133. The port plug housing 133 can also include one or more fastener holes 137 to secure the port plug housing 133 within the port plug housing receiver 134. The port plug housing 133 that contains the burst disk can be inserted from the side of the filter body 113 when the filter assembly does not include a wear collar or from the side of a wear collar 128. The port plug housing 133 can be positioned such that the burst disk is in alignment with the bypass port 130 in the center of the female fishing neck 121.

The burst disk embodiments shown in FIGS. 10A-10D can provide an easier ability to pull the tubing string and the filter assembly 100 out of the wellbore. If the tubing string needs to be pulled for mechanical reasons and the filter screen is partially or completely blocked with debris, then the fluid located inside the tubing string can have difficulty draining out through the filter screen as the filter assembly is pulled to the surface. A suction can be created, which can substantially lengthen the time required to pull the tubing string because the fluid remaining in tubular sections needs to be captured with a mud bucket each time a section is disassembled. To solve this problem, the tubing string can be pressured up, which causes the burst disk to rupture and allows fluid to flow through the bypass port 130 and the second fluid-flow path 136. If a sufficient amount of pressure is not obtained to rupture the burst disk, then a lance on the end of the male fishing tool can also be used to pierce the burst disk as it engages with the female fishing neck on the upper sub 122. This would allow flow around the male fishing tool, through the female fishing neck, and through the bypass port 130, which would reduce the chances that a dangerous pressure imbalance is created during retrieval.

Figure 11A:
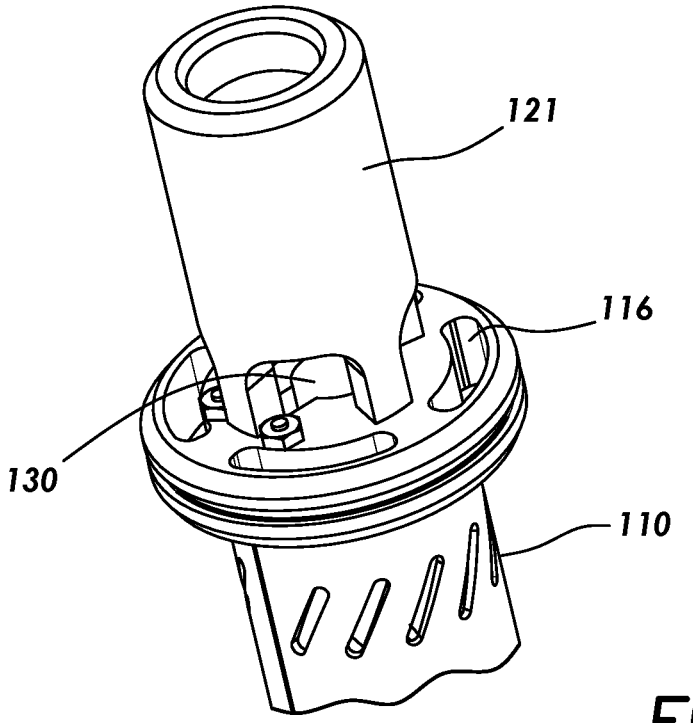
FIG. 11A is a perspective view of a filter assembly having a flapper as the bypass port plug according to certain embodiments.
Figure 11B:
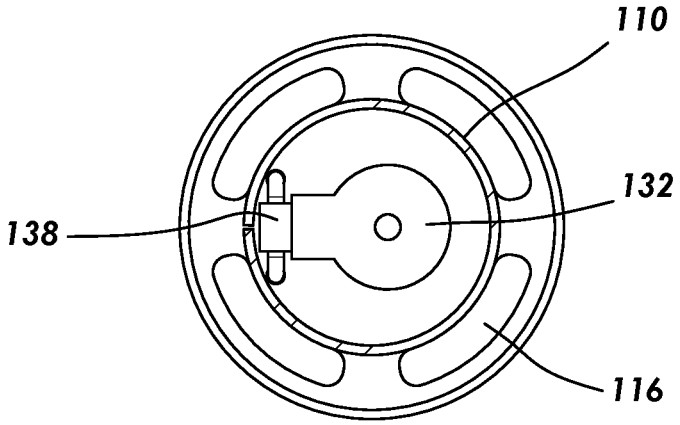
FIG. 11B is a bottom view of the flapper of FIG. 11A.
Figure 11C:
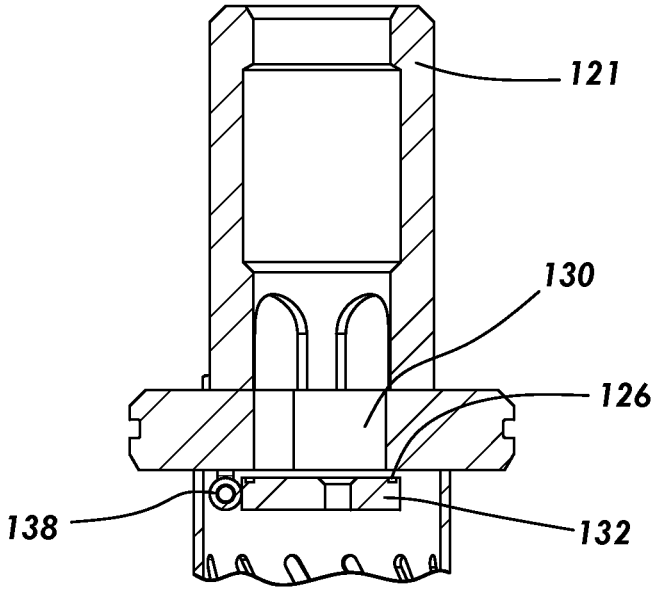
FIG. 11C is a side cross-sectional view of the filter assembly of FIG. 11A.

According to other embodiments and as shown in FIGS. 11A-11C, the bypass port plug 132 can be a flapper valve. The bypass port 130 can be located on the upper sub 122 near the center of a female fishing neck 121. The bypass port 130 can be keyhole shaped to facilitate installation of the flapper valve from the top of the upper sub 122. As can be seen in FIG. 11B, an installation hole can be located in the center of the flapper valve, wherein after installation of the flapper, the installation hole can be plugged with a fastener before introducing the filter assembly into a wellbore. A torsion spring (not shown) can retain the flapper in the closed position. The torsion spring can be selected to provide enough force on the flapper to hold the flapper in the closed position until the pressure differential is sufficient enough to overcome the spring force, thereby opening the flapper valve and the bypass port 130. As shown in FIG. 11C, the flapper valve can include a groove in which an elastomeric material can be placed to provide a positive seal between the flapper valve and the bottom of the upper sub 122 to resist bypass flow until the required pressure differential occurs.

Before the filter screen 110 becomes clogged, the flapper can be biased in a closed position via a flapper hinge 138 and torsion spring to maintain flow through the first fluid-flow path 117 of the filter screen 110 and not through the second fluid-flow path 136 of the bypass port 130. When the screen becomes clogged, pressure can build up in the fluid being pumped downhole and can push the flapper open via the flapper hinge 138 allowing at least a portion of the fluid to flow through the bypass ports 130 and the second fluid-flow path 136. According to this embodiment, the flapper opening pressure can also be designed such that the flapper will open if the filter screen becomes clogged, but also open if additional flow is needed to pass through the filter assembly 100 for a period of time. If sufficient pressure created by increased fluid flow opens the flapper, then unfiltered fluid can bypass the filter screen until the fluid flow decreases enough to allow the flapper to spring shut and close the bypass port 130 again thereby resuming filtering of the wellbore treatment fluid.

Figure 12A:
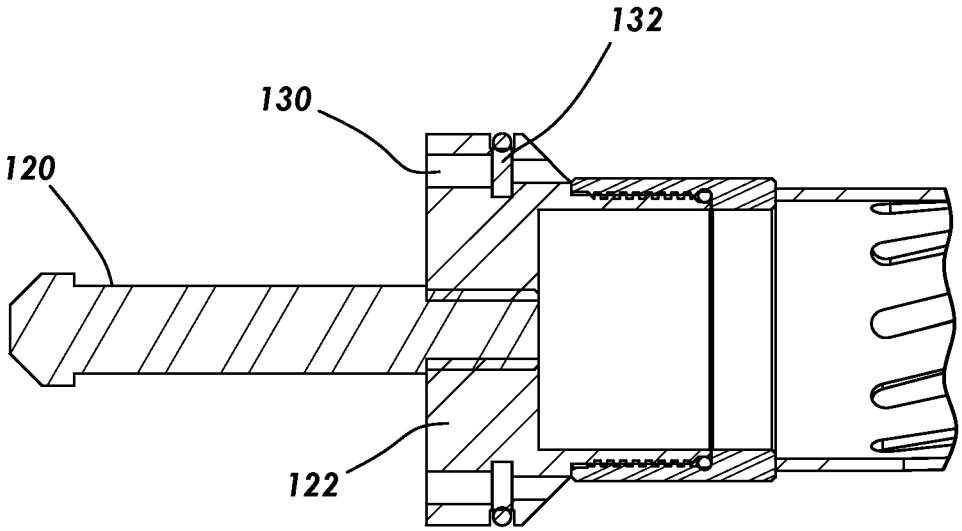
FIG. 12A is a cross-sectional view of a filter assembly having sealing elements as the bypass port plug according to certain embodiments.
Figure 12B:
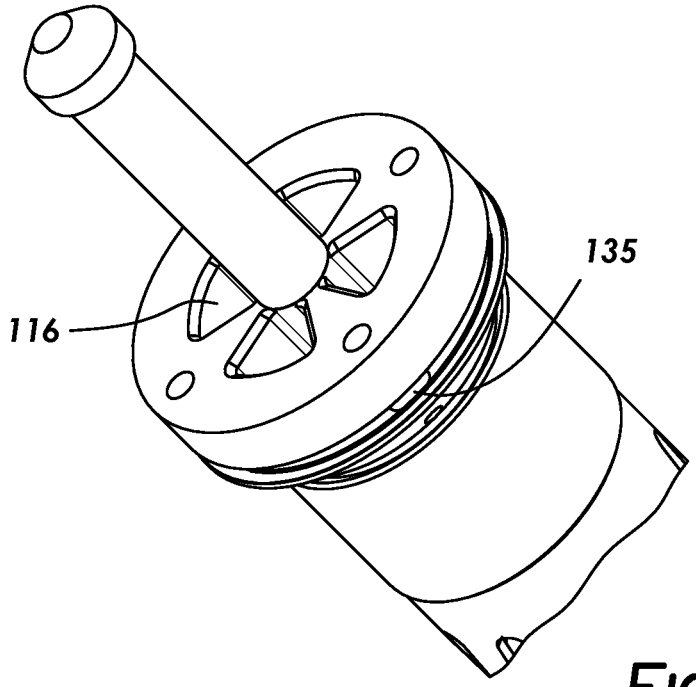
FIG. 12B is a perspective view of the filter assembly of FIG. 12A.
Figure 12C:
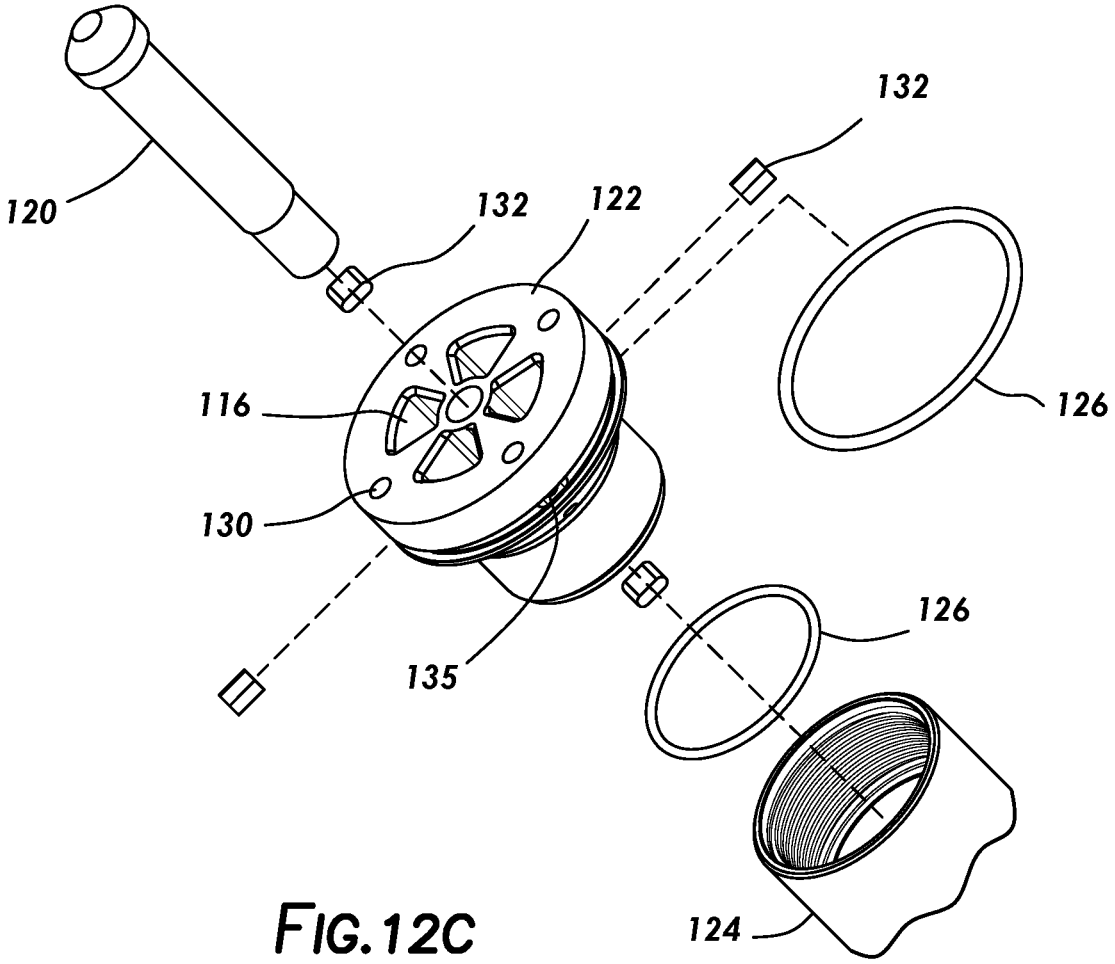
FIG. 12C is an exploded perspective view of the filter assembly of FIG. 12A.

As shown in FIGS. 12A-12C, the bypass port plugs 132 can be a material that is inserted into the bypass ports 130. The upper sub 122 can include a plurality of openings 135 for receiving the bypass port plugs 132. The shape and dimensions of the openings 135 can be selected to correspond to the dimensions and location of the bypass ports 130. The bypass port plugs 132 can be inserted into each opening 135 and afterwards a sealing element 126, such as an O-ring, can be placed into a common groove to retain the bypass port plugs 132 within the openings 135. The bypass port plugs 132 can be made of a semisolid material (e.g., sponge, rubber, wood, polymers, elastomeric materials, laminates, or any other materials) and inserted into the openings 135. The bypass ports 130 are closed until the pressure in the system exceeds a predetermined level as a result of debris clogging the filter screen 110. At the predetermined level of pressure, the bypass port plugs 132 can be forced out of the openings 135, split, or fracture to open the bypass ports 130. This embodiment may be useful whether the bypass ports 130 are located around a periphery of the upper sub 122 or located near the center of the upper sub 122.

FIGS. 13A-13I depict the filter assembly 100 according to other certain embodiments. According to these embodiments, the lower sub 124 is slidably attached to a bottom portion of the upper sub 122. A frangible device 139 retains this attachment when the bypass ports 130 are in a closed position. The frangible device 139 can be any device that is capable of withstanding a predetermined amount of force and capable of releasing at a force above the predetermined amount of force. The frangible device 139 can be, for example, a shear pin, a shear screw, a shear ring, a load ring, a lock ring, a pin, or a lug. There can also be more than one frangible device 139 that connects the lower sub 124 to the upper sub 122. The frangible device 139 or multiple frangible devices can be selected based on the force rating of the device, the total number of devices used, and the predetermined amount of force needed to release the device. For example, if the total force required to break or shear the frangible devices is 15,000 pounds force ($lb_f$) and each frangible device has a rating of 5,000 $lb_f$, then a total of three frangible devices may be used.

To maintain the shearing force on the frangible device 139, the top of the lower sub 124 can extend past an inner sealing element 126 sufficiently far to not expose the bypass ports until shearing has occurred. As the filter becomes clogged and a pressure differential between the inside and the outside of the filter assembly increases to the predetermined pressure rating of the frangible device 139, the frangible device 139 will break or shear. After shearing, the lower sub 124 and the filter screen 110 shifts downward, thus opening the bypass ports 130. The bypass ports 130 can be completely open or can be partially closed with drilled holes. If the bypass ports 130 contain drilled holes, then even when the port is open, partial filtration can still occur. Once retrieved from the wellbore for cleaning, a catch ring 127 can be removed to allow disassembly of the filter screen 110.

Figure 13A:
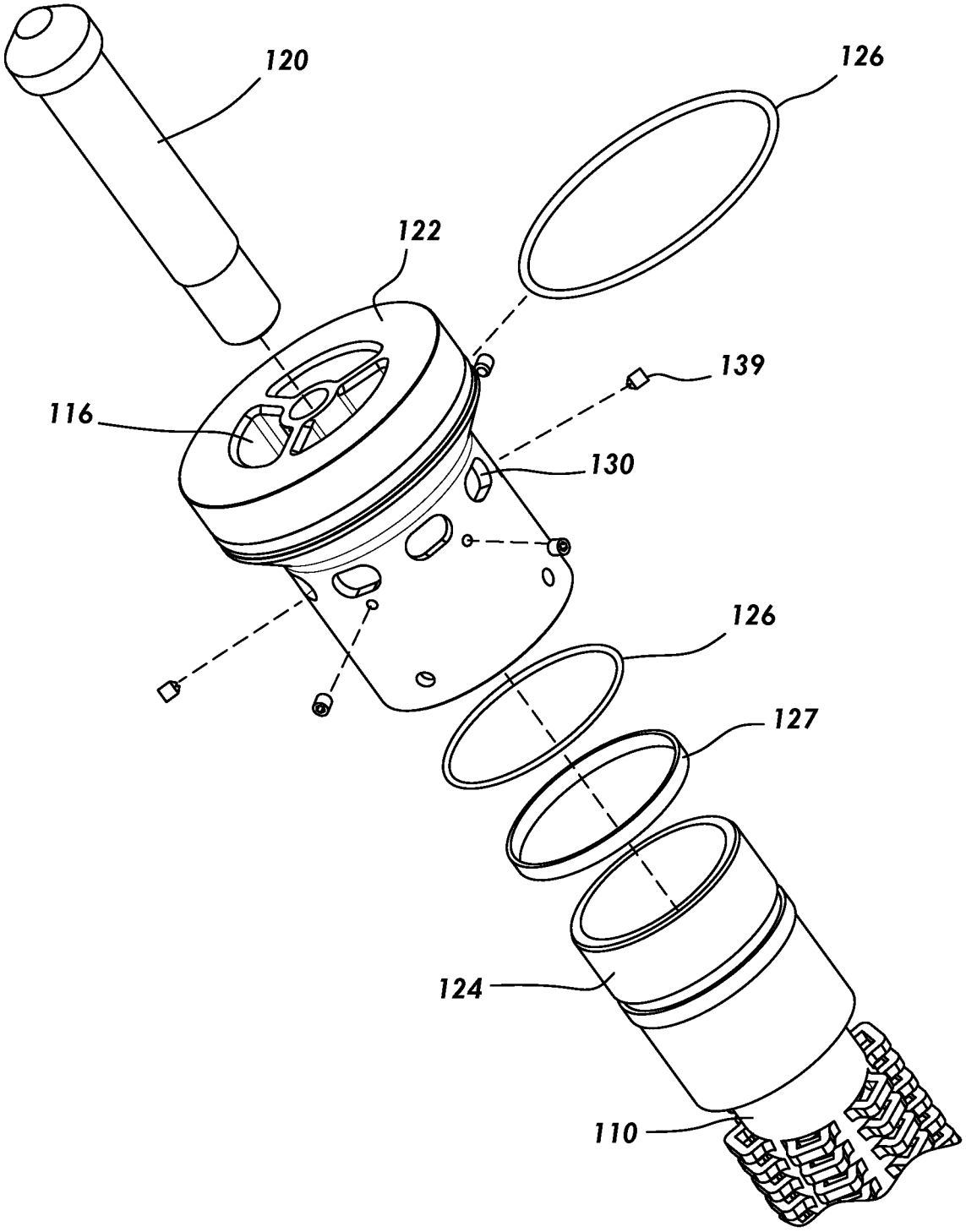
FIG. 13A is an exploded perspective view of a filter assembly having a shifting filter screen to open bypass ports according to certain embodiments.
Figure 13B:
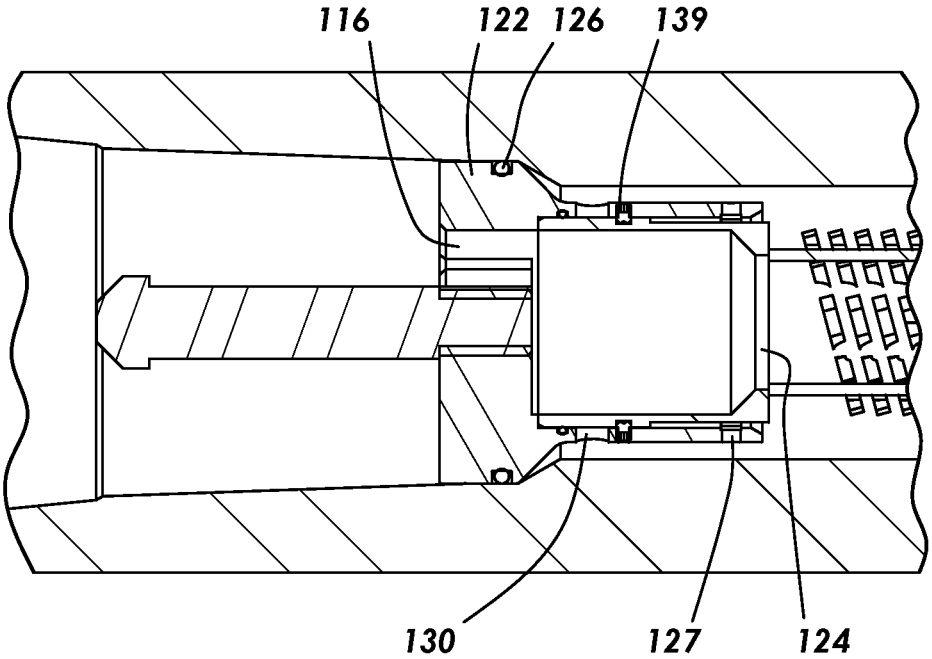
FIG. 13B is a cross-sectional view of the filter assembly of FIG. 13A showing the bypass ports in a closed position prior to shifting.
Figure 13C:
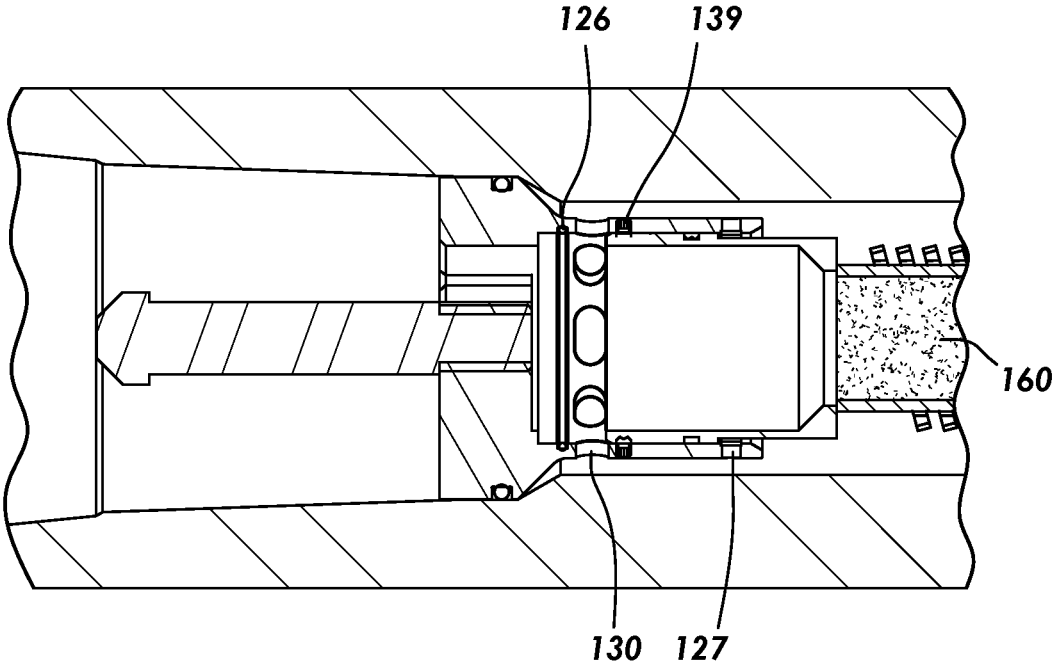
FIG. 13C is a cross-sectional view of the filter assembly of FIG. 13A showing the bypass ports in an open position after shifting.
Figure 13D:
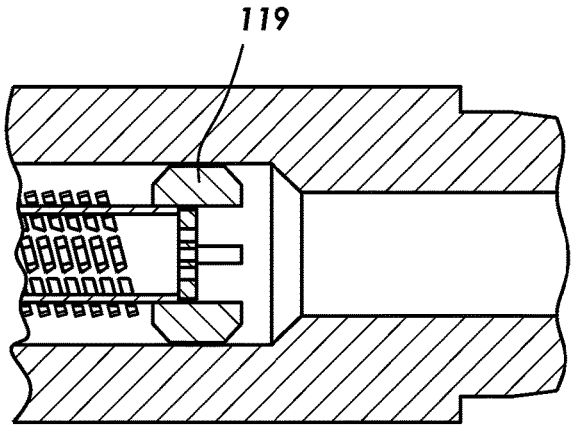
FIG. 13D is a cross-sectional view of a lower end of the filter assembly of FIG. 13A prior to shifting.
Figure 13E:
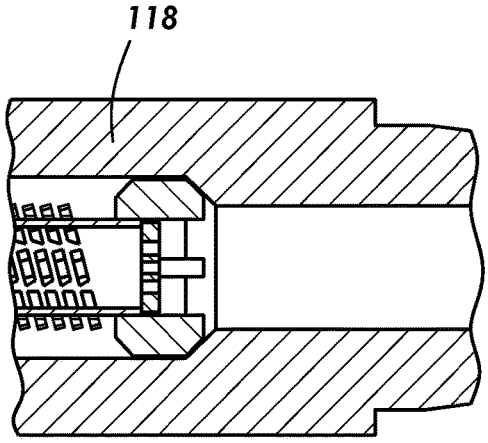
FIG. 13E is a cross-sectional view of the lower end of the filter assembly of FIG. 13A after shifting.
Figure 13F:
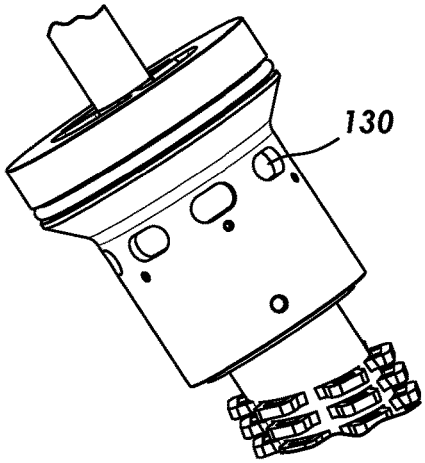
FIG. 13F is a perspective view of the upper end of the filter assembly of FIG. 13A showing the bypass ports in a closed position prior to shifting.
Figure 13G:
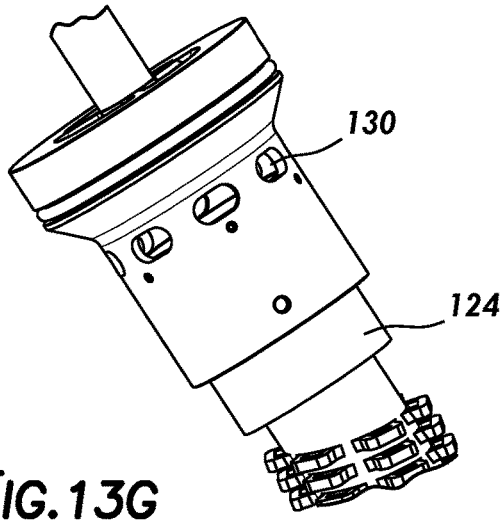
FIG. 13G is a perspective view of the upper end of the filter assembly of FIG. 13A showing the bypass ports in an open position after shifting.
Figure 13H:
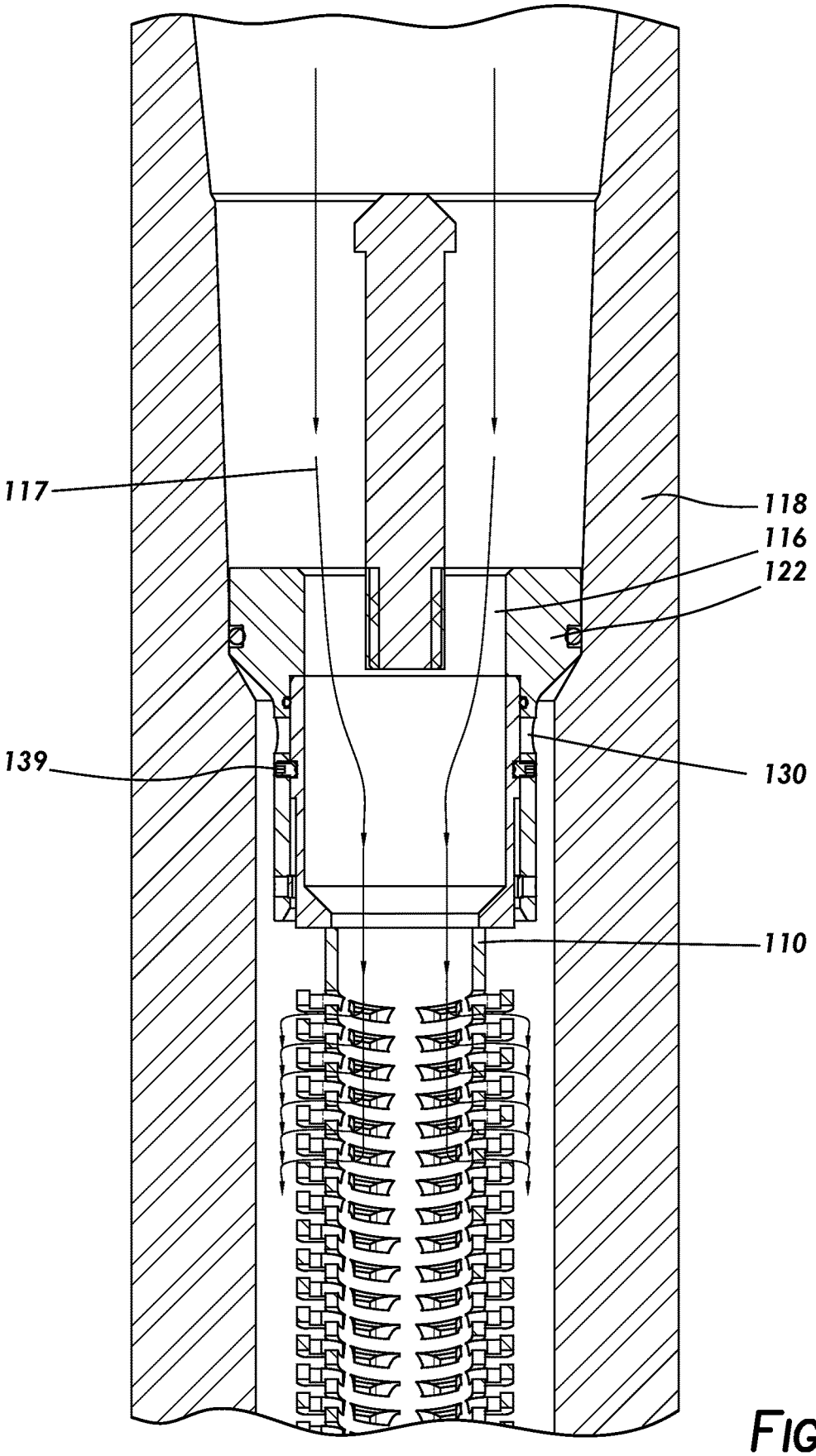
FIG. 13H is a cross-sectional view of the filter assembly of FIG. 13A with the bypass ports closed and showing a first fluid flow path through the filter.
Figure 131:
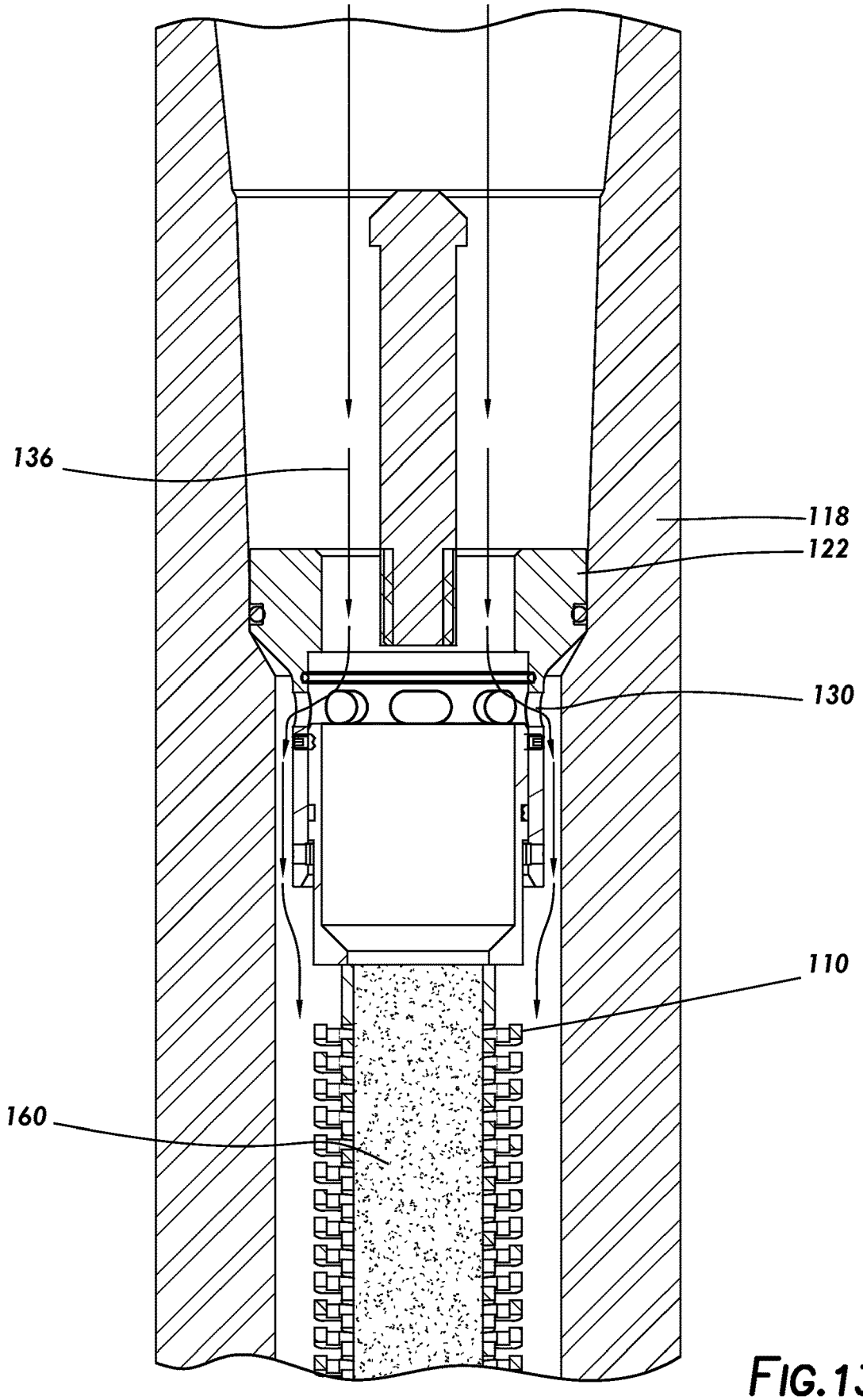

FIGS. 13H and 13I show an example orientation in which the first fluid-flow path 117 is directing fluid flowing through the filter assembly 100. This orientation and fluid-flow path continues until the filter screen 110 becomes clogged at which time a pressure differential across the upper sub 122 causes the bypass ports 130 to convert from a closed position to an open position. After the bypass ports 130 are opened, FIG. 13I shows the second fluid-flow path 136 that directs at least a portion of the fluid through the open bypass ports 130. It is to be understood, that the first and second fluid-flow paths would be the same as depicted in FIGS. 13H and 13I regardless of the mechanism used to open the fluid bypass ports (e.g., ball check valves, flapper valves, frangible devices, etc.) and shift fluid flow from the first fluid-flow path 117 into the second fluid-flow path 136. It is also to be understood that the first and second fluid-flow paths can be reversed, for example, as shown in FIG. 10A. When the bypass ports are opened via a frangible device it may be necessary to add a seal near the bottom plate or a debris sleeve to allow a pressure differential to shear the frangible device. One of ordinary skill in the art can design the filter assembly in order to provide the desired first and second fluid-flow paths based on the mechanism used to open the bypass ports.

As can be seen in FIGS. 13D and 13E, the filter assembly 100 can include one or more centralizers 119 located at a bottom end of the filter screen 110. The centralizers 119 can extend away from an outside of the filter body 113 into the annulus 140 located between the outside of the filter body and the inside of the housing 118 or the debris sleeve 150 if used. The centralizers 119 can be used to centrally align the filter body 113 within the housing. As shown, the housing 118 can include a shoulder and the centralizers 119 can have a shape that allows the centralizers 119 to shoulder up against the housing 118 after the frangible device 139 has sheared and the lower sub 124 and filter body 113 has shifted down to open the bypass ports 130.

It should be understood that the various embodiments disclosed can be used as individual embodiments or can be used in conjunction with another embodiment.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more bypass ports, fluid flow paths, etc., as the case may be, and does not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A filter assembly for use in a wellbore comprising:

a filter inlet port;

a first fluid-flow path;

a filter screen, wherein a fluid flows through the filter screen via the filter inlet port and the first fluid-flow path;

a second fluid-flow path; and one or more bypass ports, wherein the one or more bypass ports are in a closed position as the fluid flows through the first fluid-flow path, wherein the one or more bypass ports convert from the closed position to an open position after a predetermined pressure is obtained in the first fluid-flow path, and wherein at least a portion of the fluid flows through the second fluid-flow path after the one or more bypass ports convert to the open position.

2. The filter assembly according to claim 1, wherein the filter screen is attached to a lower sub.

3. The filter assembly according to claim 2, wherein the lower sub is threadingly connected to an upper sub.

4. The filter assembly according to claim 1, wherein at least the filter screen is removably connected to the filter assembly for cleaning.

5. The filter assembly according to claim 1, wherein the filter inlet port is located near a center of an upper sub and the first fluid-flow path runs through an inside of the filter screen, traverses through the filter screen, and to an outside of the filter screen, and wherein the one or more bypass ports are located near a periphery of the upper sub and the second fluid-flow path is on the outside of the filter screen.

6. The filter assembly according to claim 1, wherein the filter inlet port is located near a periphery of an upper sub and the first fluid-flow path runs from an outside of the filter screen, traverses through the filter screen, and to an inside of the filter screen, and wherein the one or more bypass ports are located near a center of the upper sub and the second fluid-flow path is into the inside of the filter screen.

7. The filter assembly according to claim 1, wherein a bypass port plug is positioned within the one or more bypass ports, and wherein the bypass port plug is selected from a ball check valve, a flapper valve, a burst disk, or a rigid to semi-rigid material.

8. The filter assembly according to claim 1, wherein the filter screen is attached to a lower sub, wherein the lower sub is slidably attached to a bottom portion of an upper sub via a frangible device, wherein the one or more bypass ports are located on the upper sub, and wherein the bypass ports are in the closed position when the lower sub is attached to the upper sub via the frangible device.

9. The filter assembly according to claim 8, wherein the frangible device is selected from a shear pin, a shear screw, a shear ring, a load ring, a lock ring, a pin, or a lug.

10. A method of treating a portion of a wellbore comprising:

introducing a filter assembly into the wellbore, wherein the filter assembly comprises:
- a first fluid-flow path;
- a filter screen;
- a second fluid-flow path; and
- one or more bypass ports;

flowing a wellbore treatment fluid through filter screen via the first fluid-flow path, wherein the one or more bypass ports are in a closed position as the wellbore treatment fluid flows through the first fluid-flow path; and causing or allowing the one or more bypass ports to convert from the closed position into an open position, wherein at least a portion of the wellbore treatment fluid flows through the second fluid-flow path after the one or more bypass ports are converted to the open position.

11. The method according to claim 10, wherein a bypass port plug is positioned within the one or more bypass ports, wherein the bypass port plug is a ball check valve, wherein a pressure differential is created when the filter screen becomes sufficiently clogged such that fluid flowing through the first fluid-flow path is substantially restricted or stops, and wherein the pressure differential moves the ball of the ball check valve and causes the bypass port to convert into the open position.

12. The method according to claim 10, wherein a bypass port plug is positioned within the one or more bypass ports, wherein the bypass port plug is a burst disk, wherein a pressure differential is created when the filter screen becomes sufficiently clogged such that fluid flowing through the first fluid-flow path is substantially restricted or stops, and wherein the pressure differential ruptures the burst disk and causes the bypass port to convert into the open position.

13. The method according to claim 10, wherein a bypass port plug is positioned within the one or more bypass ports, wherein the bypass port plug is a flapper valve, wherein a pressure differential is created when the filter screen becomes sufficiently clogged such that fluid flowing through the first fluid-flow path is substantially restricted or stops, and wherein the pressure differential pushes a flapper of the flapper valve open and causes the bypass port to convert into the open position.

14. The method according to claim 10, wherein the filter assembly further comprises an upper sub, wherein the upper sub comprises a plurality of openings that traverse a plurality of the bypass ports, wherein a bypass port plug is located within each of the plurality of openings, wherein a pressure differential is created when the filter screen becomes sufficiently clogged such that fluid flowing through the first fluid-flow path is substantially restricted or stops, and wherein the pressure differential causes the bypass port plugs to be forced out of the plurality of the openings, split, or fracture and causes the plurality of the bypass ports to convert into the open position.

15. The method according to claim 10, wherein the filter screen is attached to a lower sub, wherein the lower sub is slidably attached to a bottom portion of an upper sub via a frangible device, wherein the one or more bypass ports are located on the upper sub, and wherein the bypass ports are in the closed position when the lower sub is attached to the upper sub via the frangible device.

16. The method according to claim 15, wherein the frangible device is selected from a shear pin, a shear screw, a shear ring, a load ring, a lock ring, a pin, or a lug.

17. The method according to claim 15, wherein a pressure differential is created when the filter screen becomes sufficiently clogged such that fluid flowing through the first fluid-flow path is substantially restricted or stops, wherein the frangible device breaks or shears when the pressure differential equals or exceeds the pressure rating of the frangible device, and wherein the breaking or shearing of the frangible device causes the lower sub and the filter screen to shift downwards and causes the one or more bypass ports to convert to the open position.

18. A filter assembly for use in a wellbore, wherein the filter assembly comprises:

a housing of the filter assembly;

a filter screen body;

a filter screen located around a periphery of the filter screen body and within a portion of the housing; and a debris sleeve located circumferentially around at least a portion of the filter screen, wherein the debris sleeve comprises a top end and a bottom end, wherein the top end is located closer to a wellhead of the wellbore and the bottom end is located farther away from the wellhead of the wellbore, wherein the debris sleeve is closed at the bottom end and configured to capture debris from the filter screen, and wherein the debris sleeve is located within the housing.

19. The filter assembly according to claim 18, wherein the filter screen body comprises a bottom plate, and wherein the bottom end of the debris sleeve comprises one or more holes for attaching the debris sleeve to the bottom plate.

20. The filter assembly according to claim 18, wherein the debris sleeve completely surrounds an outside of the filter screen.

* * * * *